US007537554B2

(12) United States Patent
Zhuang

(10) Patent No.: US 7,537,554 B2
(45) Date of Patent: May 26, 2009

(54) MULTI-FUNCTIONAL PERSONAL FITNESS APPARATUS

(76) Inventor: James Jia Zhuang, 5728 Sterling Oaks Dr., Brentwood, TN (US) 37027

( * ) Notice: Subject to any disclaimer, the term of this patent is extended or adjusted under 35 U.S.C. 154(b) by 392 days.

(21) Appl. No.: 11/648,231

(22) Filed: Dec. 29, 2006

(65) Prior Publication Data

US 2007/0270293 A1 Nov. 22, 2007

Related U.S. Application Data

(60) Provisional application No. 60/800,770, filed on May 16, 2006.

(51) Int. Cl.
*A63B 26/00* (2006.01)
*A63B 21/02* (2006.01)
*A63B 21/04* (2006.01)

(52) U.S. Cl. ..... 482/142; 482/121; 482/130

(58) Field of Classification Search ..... 482/130, 482/142, 121, 123, 129
See application file for complete search history.

(56) References Cited

U.S. PATENT DOCUMENTS 3,640,529 A * 2/1972 Kane ..... 482/129
4,160,553 A 7/1979 Fleischer
4,294,426 A 10/1981 Fleischer
4,826,248 A 5/1989 Poo
4,861,020 A 8/1989 Soligny, Sr.
4,911,438 A * 3/1990 Van Straaten ..... 482/96
5,074,551 A * 12/1991 Olschansky et al. ..... 482/137
5,302,161 A 4/1994 Loubert et al.
5,637,066 A * 6/1997 Chang ..... 482/126
5,720,699 A * 2/1998 Musachio et al. ..... 482/122
5,724,698 A 3/1998 Mondragon
6,193,638 B1 * 2/2001 Barrett ..... 482/128
6,458,062 B2 * 10/2002 Conner ..... 482/129
6,487,390 B1 11/2002 Virine et al.
6,604,138 B1 8/2003 Virine et al.
6,671,736 B2 12/2003 Virine et al.
6,705,976 B1 3/2004 Piane
6,725,484 B2 4/2004 Drenik
6,742,635 B2 6/2004 Hirshberg

* cited by examiner

*Primary Examiner*—Jerome Donnelly
(74) *Attorney, Agent, or Firm*—Morris, Manning & Martin LLP; Tim Tingkang Xia

(57) ABSTRACT

A multi-purpose fitness apparatus. The apparatus includes an extendable base, a height-adjustable weight-supporting frame, a resistance assembly providing adjustable resistance, an exercise mechanism, a detachable bench assembly, and a connecting mechanism connecting the exercise mechanism to the resistance assembly. The resistance assembly includes a supporting frame having a lower resistance support and an upper resistance support that is slidably coupled to the lower resistance support. A top spring-attachment member is mounted on the top end portion of the upper resistance support. A bottom spring-attachment member is moveably coupled to a vertical track member mounted on the lower resistance support. The movement of the bottom spring-attachment member is resisted by resistance from one or more resilient resistance members detachably affixed to the spring-attachment members. The amount of resistance is adjustable by selecting the number of the resistance members affixed.

50 Claims, 14 Drawing Sheets

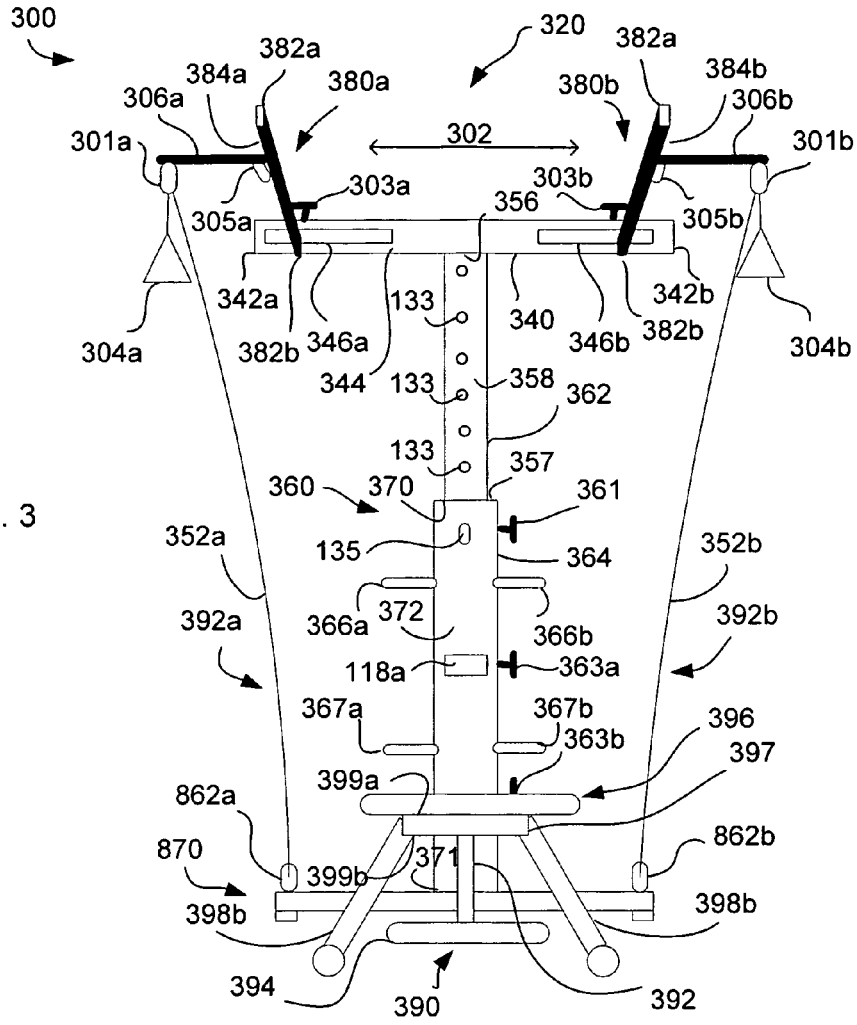
FIG. 3
FIG. 4A
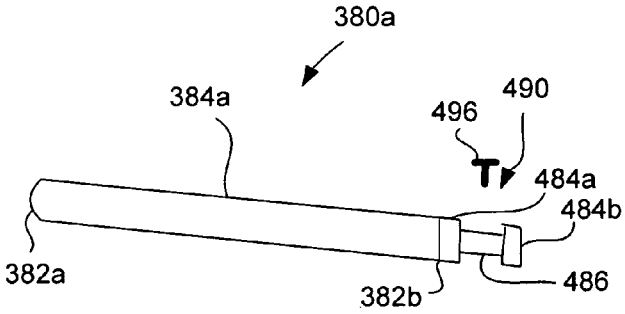
FIG. 4B
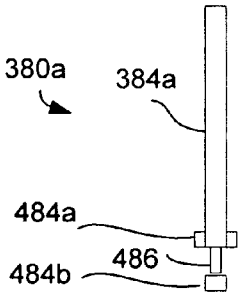

MULTI-FUNCTIONAL PERSONAL FITNESS APPARATUS

CROSS-REFERENCE TO RELATED PATENT APPLICATION

This application claims the benefit, pursuant to 35 U.S.C. § 119(e), of U.S. provisional patent application Ser. No. 60/800,770 filed May 16, 2006, entitled "MULTI-FUNCTIONAL PERSONAL FITNESS APPARATUS" by James Jia Zhuang, which is incorporated herein by reference in its entirety.

FIELD OF THE INVENTION

The present invention generally relates to an exercise equipment apparatus, and in particular relates to a fitness apparatus and providing a fitness apparatus that allows a user to selectively modify a resistance level.

BACKGROUND OF THE INVENTION

In recent years, there has been a trend towards the use of an exercise equipment to increase muscle and body mass, whether it is at a gym or at home. Although more and more people seek better weight exercise equipments and gym machines for use at home, office or fitness club, current gym exercise equipments available in the market hardly satisfy people's needs because in many instances the equipments are cumbersome, heavy to be moved around and occupy a large space. In addition, many gym exercise machines have limited functions due to the fact that they can only exercise one or few parts of the body. For instance, an abdominal exercise bench or a weight-lifting equipment provides only one kind of exercise function. To exercise different parts of muscle or body, a user has to use various kinds of gym exercise machines or exercise equipments. This not only increases the time and cost of exercise but also requires a significant amount of space for setting up various gym exercise equipments. It also causes inconvenience to users.

Most, if not all, gym exercise machines work by having human body muscle part against weights or tensions provided by an object during the exercise of that particular part of muscle. For example, many gym exercise devices use free weights or other heavy weights to provide resistance during an exercise regime. This type of gym exercise machines usually requires a much larger and heavier machine frame to support heavy weights such as metal bricks, which are cumbersome, difficult to use, and heavy to be moved from one location to another. Unpleasant noise is produced when a heavy weight metal brick falls on one below it as it is being operated.

Some exercise devices attempt to overcome the shortcomings posed by the use of heavy weights in providing resistance to an exercise user. Some exercise devices use bows to replace heavy weights, for example, Bowflex type of gym exercise machine. The bows bend and create a resistance when they are being pulled from one end of a gym exercise machine. By selecting the number of bows to be used, a user can vary the level of the resistance or tensions. The bow-based gym exercise machine is lighter than the heavy-weights-based gym exercise machine. It, however, occupies a large space when the bows of the exercise machine are pulled open. Besides, the bow-based gym exercise machine may cause harm to the people near it when the bows are bent from a close to an open position, or are retracted from an open to a close position.

Therefore, a heretofore unaddressed need exists in the art to address the aforementioned deficiencies and inadequacies, especially in connection with the making of multi-purpose fitness apparatuses.

SUMMARY OF THE INVENTION

The present invention seeks to solve the problems and limitations posed in current exercise apparatuses by providing a multi-purpose fitness apparatus for exercising different body and/or muscle parts that is lighter, more compact, and adjustable in the resistance level and height, and portable.

In one aspect, the invention relates to a resistance assembly for a fitness apparatus, which includes: (a) a base, (b) a supporting frame vertically mounted on the base, (c) a vertical track member, (d) a top spring-attachment member, (e) a bottom spring-attachment member, and (f) a resilient resistance member.

In one embodiment, the supporting frame is detachably mounted on the base. The supporting frame includes a lower resistance support and an upper resistance support that is slidably coupled to the lower resistance support. Both the upper and lower resistance supports have a respective body portion that is defined by respective top and bottom end portions. Preferably, the body portion of the lower resistance support is adapted for enabling the upper resistance support to slide into and lodge inside the lower resistance support.

The vertical track member is mounted on the lower resistance support of the supporting frame, and extends vertically from about the top to about the bottom end portion of the lower resistance support.

Both the top and bottom spring-attachment members have a respective body portion that is defined by corresponding first and an opposite, second end portions. The top spring-attachment member extends horizontally and is mounted on about the top end portion of the upper resistance support. The bottom spring-attachment member extends substantially parallel to and spaced apart from the top spring-attachment member, and is moveably coupled to the vertical track member such that a movement of the bottom spring-attachment member occurs within the vertical track member.

The resilient resistance member has a body portion with a body length of l defined by a top end portion and a bottom end portion. Extending substantially vertical to the top and bottom spring-attachment members, the resilient resistance member has its top and bottom end portions detachably affixed to the top and bottom spring-attachment members, respectively.

Each spring-attachment member has at least one attachment mechanism that is formed on its own body portion. The attachment mechanism is adapted for enabling the end portions of the resilient resistance member to be affixed thereto. The attachment mechanism may be one of an aperture, a groove, a notch, or a slot.

Each end portion of the resilient resistance member has a hook that is adapted for detachably affixing the resilient resistance member to the attachment mechanism of the spring-attachment member. The resilient resistance member may be one of an elastomeric member and a spring.

Preferably, the resilient resistance member includes a plurality of resistance members such that a choice of a number of the resistance member to be affixed to the top and bottom spring-attachment members selectively adjusts an amount of resistance being applied to the movement of the bottom spring-attachment member.

The body length l of the resilient resistance member is stretched as the bottom spring-attachment member moves downward within the vertical track member, and is recovered when the bottom spring-attachment member returns to a starting location.

The bottom spring-attachment member includes a coupling mechanism that is adapted for moving up and down within the vertical track member such that the bottom spring-attachment member moves accordingly. In one embodiment, the coupling mechanism has a ball-like structure that is mounted on the body portion of the bottom spring-attachment member in such that the end portions of the bottom spring-attachment member are symmetrical with respect to the ball-like structure.

Optionally, the resistance assembly as described above may include: (a) a pair of supporting frames, in which each supporting frame extends substantially parallel to and is spaced apart from the other supporting frame, (b) a pair of bottom spring-attachment members, in which each bottom spring-attachment member is moveably coupled to the respective vertical track member, and (c) a plurality of resilient resistance members, in which each resilient resistance member is detachably affixed to the top spring-attachment member and the respective bottom spring-attachment member.

The top spring-attachment member therein is symmetrically mounted on the respective upper resistance supports of the pair of supporting frames. Moreover, the top spring-attachment member has a plurality of attachment mechanisms, and each bottom spring-attachment member has at least one corresponding attachment mechanism, which are formed on the respective body portions of the top and bottom spring-attachment members, and wherein the attachment mechanisms is adapted for enabling the end portions of the resilient resistance member to be affixed thereto.

Another aspect of the invention relates to a multi-purpose fitness apparatus that has: (a) a base, (b) a weight-supporting frame that is vertically mounted on the base, (c) at least one exercise mechanism that is coupled to the weight-supporting frame, (d) a resistance assembly for providing adjustable resistance, in which the resistance assembly is vertically mounted on the base and located posterior to the weight-supporting frame; and (e) a connecting mechanism that couples the exercise mechanism to the resistance assembly such that a movement of the exercise mechanism is resisted by a resistance provided by the resistance assembly.

The resistance assembly in one embodiment includes: (i) a supporting frame that is vertically mounted on the base, (ii) a vertical track member, (iii) a top spring-attachment member, (iv) a bottom spring-attachment member, and (v) a resilient resistance member. The exercise mechanism includes a handle pull down mechanism, a handle bar, a squat bar and a leg exercise mechanism. The connecting mechanism, including a cable and pulley system, connects the exercise mechanism to the resistance assembly.

The weight-supporting frame further includes: (a) a vertical frame that is vertically mounted on the base, and has a lower holding bar and an upper support bar that is slidably coupled to the lower holding bar, (b) a horizontal frame that is symmetrically mounted onto the top end portion of the upper support bar, and (c) a pair of arms, each being coupled to the horizontal frame, and extending symmetrical to the other arm with respect to the vertical frame.

In one embodiment of the invention, the lower holding bar's bottom end portion is detachably mounted on the base. Both the upper support bar and the lower holding bar have a body portion that is defined by a top end portion and a bottom end portion. The horizontal frame has a body portion defined by a first end portion and an opposite, second end portion. Each arm has a respective body portion that is defined by a front end portion and a rear end portion.

The upper support bar includes a plurality of coupling members formed on the body portion thereof in a vertical arrangement. Each coupling member is adapted for cooperating with a corresponding coupling member formed on the body portion of the lower holding bar. The coupling member on the upper support bar may be one of an aperture, a groove, a notch and a slot.

The horizontal frame further includes an arm track extending horizontally and operably coupled to the pair of arms such that the pair of arms is moveable within the arm track, thereby resulting in an adjustment of a distance between the pair of arms.

In one embodiment of the invention, the arm track includes a pair of arm tracks, in which each arm track is spaced apart from the other arm track and coupled to a respective arm such that each arm is independently moveable within the corresponding arm track, thereby resulting in an adjustment of a distance between the pair of arms. The arm track may be coupled to each arm through an arm-track coupling mechanism that is mounted to the rear end of each arm.

Optionally, the multi-purpose fitness apparatus may have a resistance assembly that includes: (a) a pair of supporting frames, in which each supporting frame extends substantially parallel to and is spaced apart from the other supporting frame, (b) a pair of bottom spring-attachment members, in which each bottom spring-attachment member is moveably coupled to the respective vertical track member, and (c) a plurality of resilient resistance members, in which each resilient resistance member is detachably affixed to the top spring-attachment member and the respective bottom spring-attachment member. The top spring-attachment member therein is symmetrically mounted on the respective top end portions of the corresponding upper resistance supports.

Each bottom spring-attachment member has at least one, and the top spring-attachment member has a plurality of attachment mechanisms formed on the respective body portions thereof, in which the attachment mechanism is adapted for enabling the end portion of the resilient resistance member to be affixed thereto.

The multi-purpose fitness apparatus may further include a bench assembly that is moveably and detachably coupled to the lower holding bar of the vertical frame of the weight-supporting frame. The bench assembly has: (a) an elongate bench frame that has a body portion defined by a front end portion and a rear end portion, in which the body portion has a top surface and a bottom surface, (b) a frame-connecting member that is mounted to the rear end portion of the elongate bench frame and adapted for moveably and detachably connecting the elongate bench frame to the lower holding bar of the vertical frame, and (c) a seat pad that is moveably and detachably coupled to the top surface of the elongate bench frame. Additionally, the multi-purpose fitness apparatus may further include a male connector extending substantially vertical to and mounted on the frame-connecting member.

According to one embodiment of the invention, the multi-purpose fitness apparatus includes a leg exercising mechanism that has a leg lever and a leg support. The leg support is substantially perpendicular to the leg lever, and is flexibly coupled to the bottom surface of the front end portion of the elongate bench frame. Moreover, the front end portion of the elongate bench frame is adapted for receiving and engaging the leg support of the leg exercising mechanism.

Preferably, the lower holding bar may include at least one frame-connecting-member receiver that is formed on the body portion thereof, in which the frame-connecting-member receiver is adapted for enabling the frame-connecting member of the bench assembly to be affixed thereto. The frame-connecting-member receiver may be one of an aperture, a groove, a notch and a slot.

Optionally, the vertical frame may include at least one foot-holder that is mounted on the lower holding bar thereof, in which the at least one foot-holder extends horizontally and is adapted for anchoring a user's feet as the user doing a sit-up exercise.

Preferably, the bench assembly further includes a wheel that is operably coupled to the bottom surface adjacent to the rear end portion of the elongate bench frame.

The bench assembly may further include a clip that is adapted for detachably affixing the seat pad to the elongate bench frame. The seat pad includes a front seat pad and a rear seat pad, and the rear seat pad is moveably coupled to the front seat pad such that an angle $\alpha$ is defined between the front seat pad and the rear seat pad, in which the angle $\alpha$ is $0 \leqq \alpha \leqq 180$.

The base of the multi-purpose fitness apparatus includes: (a) a pair of support bars, (b) a connecting bar that connects the pair of support bars and forms a vertical angle with each support bar, (c) a pair of pull-out bars that are slidably attached to the respective support bars, (d) a pull-out-bar connector connecting the front end portions of the pair of pull-out bars and forming a vertical angle with each pull-out bar, and (e) a platform having a body portion defined by a front end portion and rear end portion, in which the front end portion thereof is attached to the pull-out bar connector such that a movement of the pair of pull-out bars simultaneously moves the platform.

Each support bar of the base extends parallel to and is spaced apart from the other support bar. Likewise, each pull-out bar extends parallel to and is spaced apart from the other pull-out bar. Each support bar and each pull-out bar have a body portion that is defined by a front end and a rear end portion. Preferably, the body portion of the support bars is adapted for enabling the pair of pull-out bars to slide in and out.

In one embodiment of the invention, the platform of the base is situated below the connecting bar. The base has a female connector that is adapted for enabling the male connector of the bench assembly to be affixed thereto.

These and other aspects will become apparent from the following description of the preferred embodiment taken in conjunction with the following drawings, although variations and modifications therein may be affected without departing from the spirit and scope of the novel concepts of the disclosure.

The accompanying drawings illustrate one or more embodiments of the invention and, together with the written description, serve to explain the principles of the invention. Wherever possible, the same reference numbers are used throughout the drawings to refer to the same or like elements of an embodiment.

BRIEF DESCRIPTION OF THE DRAWINGS

FIG. 3 illustrates a front view of a fitness apparatus in accordance with another embodiment of the invention.

FIG. 4A illustrates a side view of an arm showing an arm-track coupling mechanism connected to one end of the arm.

FIG. 4B illustrates a top view of the arm of FIG. 4A.

DETAILED DESCRIPTION OF THE INVENTION

Figure 1:
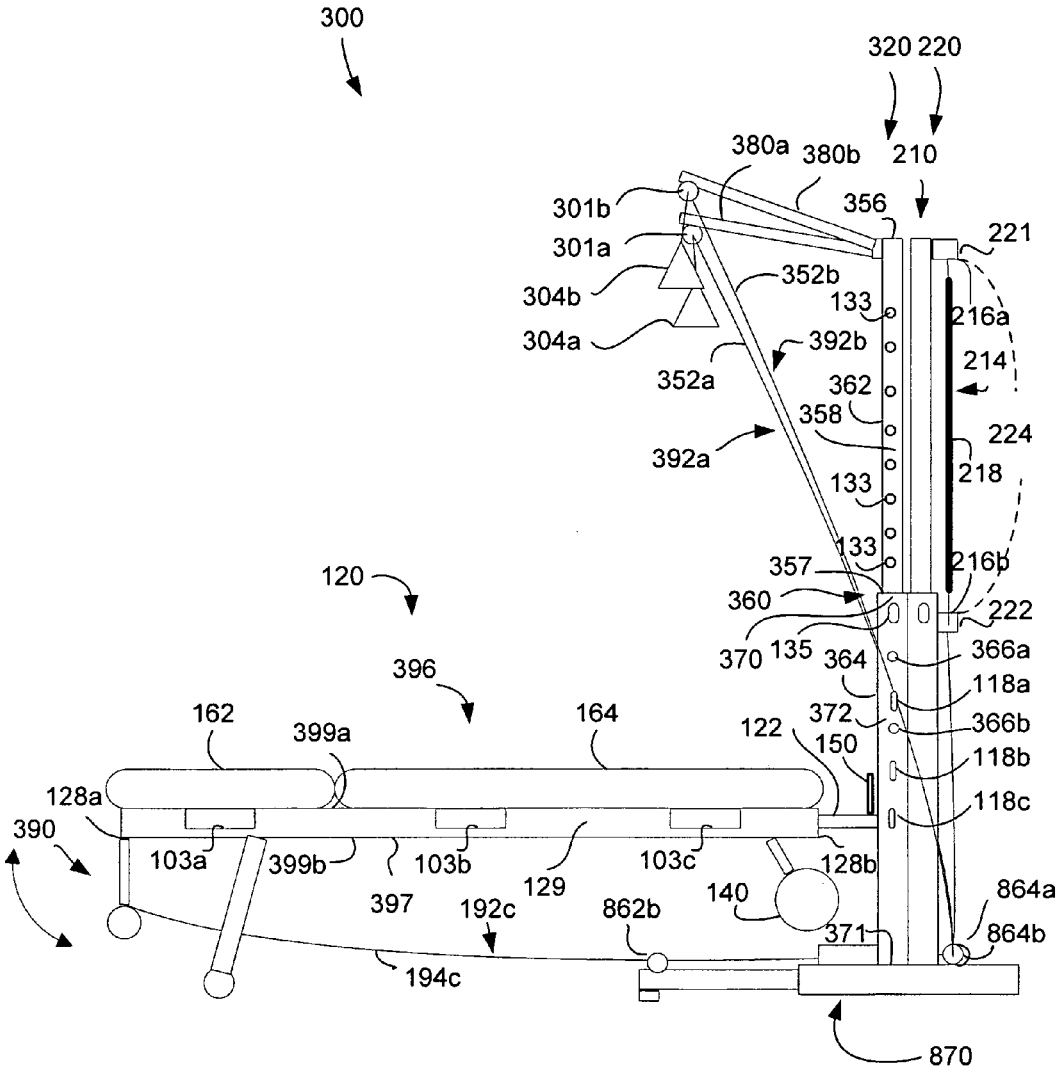
FIG. 1 illustrates a side view of a fitness apparatus in accordance with one embodiment of the present invention.

The present invention is more particularly described in the following examples that are intended as illustrative only since numerous modifications and variations therein will be apparent to those skilled in the art. Various embodiments of the invention are now described in detail. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, the term "spring," as used herein, refers to an elastic or bouncing quality, elasticity or resilience. The term "hook," as used herein, refers to a curved or angular piece of metal or other hard substance for catching, pulling, holding, or suspending something. The term "horizontal," as used herein, refers to "parallel to level ground."

The description will be made as to the embodiments of the present invention in conjunction with the accompanying drawings of FIGS. 1-15. In accordance with the purposes of this invention, as embodied and broadly described herein, this invention in one aspect relates to a fitness apparatus that has an adjustable resistance assembly that provides resistance to an exercising user as he or she manipulates the exercise mechanisms of the fitness apparatus. This resistance assembly provides a simple and efficient manner by which the user may select different resistances without the use of heavy weights. The configuration of the resistance assembly is compact, thereby limiting the overall space required or associated with the fitness apparatus. Moreover, it uses light weight resilient material to provide adjustable resistance and to cooperate with multiple exercises mechanisms, thereby providing an easy-to-reassemble and portable multi-purpose fitness apparatus. The fitness apparatus according to the invention is compact, easy to operate, flexible, user-friendly and versatile, and can be used in many places including gym, office or home, especially in places where space is limited.

With reference now to FIGS. 1 and 3-9, depicted is one configuration of a fitness apparatus according to one aspect of the present invention. Fitness apparatus 300 includes: (i) a base 870; (ii) a weight-supporting frame 320 vertically mounted on the base 870; (iii) at least one exercise mechanism 304*a*-304*b*, 306*a*-306*b*, 722 coupled to the weight-supporting frame 320; (iv) a resistance assembly 220 vertically mounted on base 870 and located posterior to weight-supporting frame 320; and (v) a connecting mechanism 392*a*-392*b* coupling exercise mechanism 304*a*-304*b*, 306*a*-306*b*, 722 to resistance assembly 220 such that a movement of the exercise mechanism 304*a*-304*b*, 306*a*-306*b*, 722 is resisted by a resistance provided by resistance assembly 220.

With continued reference to FIGS. 1, 2A-2F, 6 and 7, resistance assembly 220 includes: (i) a supporting frame 210 having a lower resistance support 208 and an upper resistance support 212 that is slidably coupled to the lower resistance support 208; (ii) a vertical track member 240 mounted on lower resistance support 208 of supporting frame 210; (iii) a top spring-attachment member 221 extending horizontally and symmetrically mounted on about the top end portion 223 of upper resistance support 212; (iv) a bottom spring-attachment member 222 extending substantially parallel to and spaced apart from top spring-attachment member 221 and moveably coupled to vertical track member 240 such that a movement of bottom spring-attachment member 222 occurs within vertical track member 240; and (v) a resilient resistance member 214 extending substantially vertical to and detachably affixed to top and bottom spring-attachment members 221 and 222.

Referring now to FIGS. 1-3 and 6-7, weight-supporting frame 320, at least one exercise mechanism 304*a*-304*b*, 306*a*-306*b*, 722 and connecting mechanism 392*a*-392*b* will now be discussed in additional detail. Weight-supporting frame 320 further includes: (i) vertical frame 360 vertically mounted on base 870; (ii) horizontal frame 340 symmetrically mounted on vertical frame 360; and (iii) a pair of arms 380*a* and 380*b*, of which each is coupled to horizontal frame 340 and extending symmetrical to the other arm with respect to vertical frame 360.

Vertical frame 360 has a lower holding bar 364 and an upper support bar 362 that slidably couples to lower holding bar 364. Upper support bar 362 has a body portion 358 defined by a top end portion 356 and a bottom end portion 357. Lower holding bar 364 has a body portion 372 defined by a top end portion 370 and a bottom end portion 371, and the bottom end portion 371 is detachably mounted on the base 870.

Figure 6:
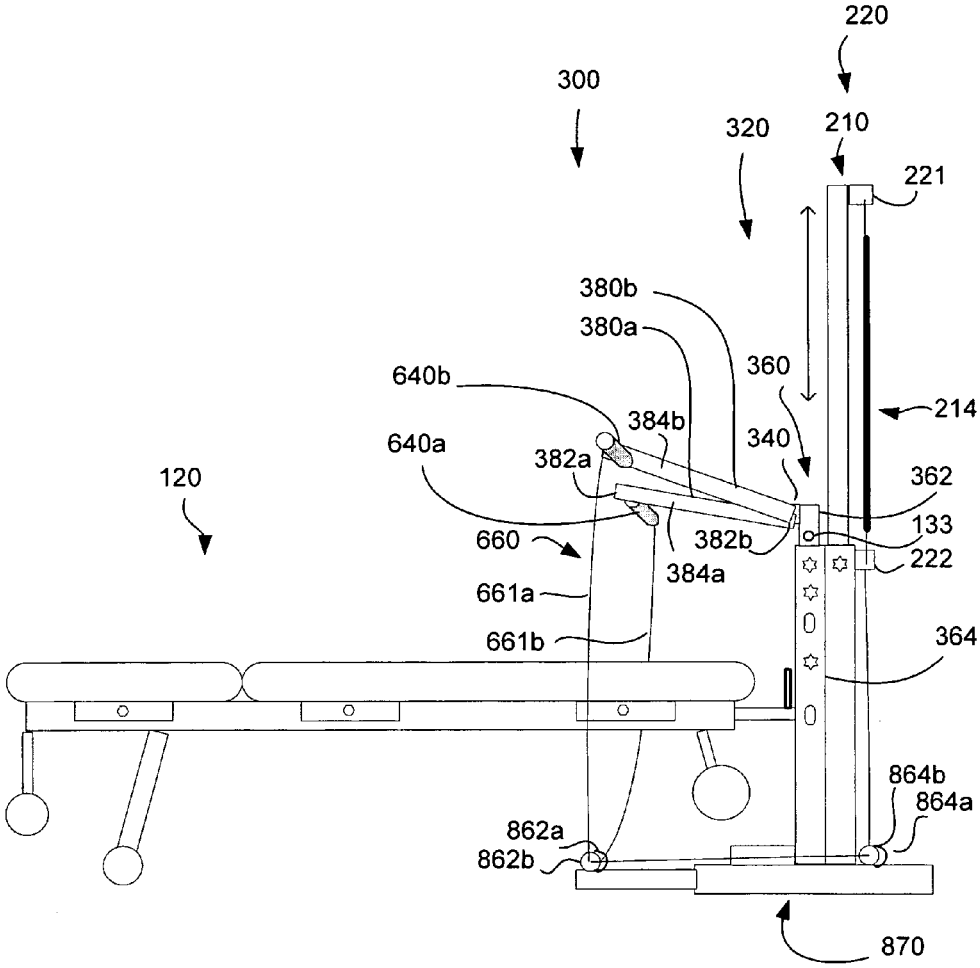
FIG. 6 illustrates a perspective view of the fitness apparatus of FIG. 3 showing a movement of an upper support frame to adjust height.
Figure 7:
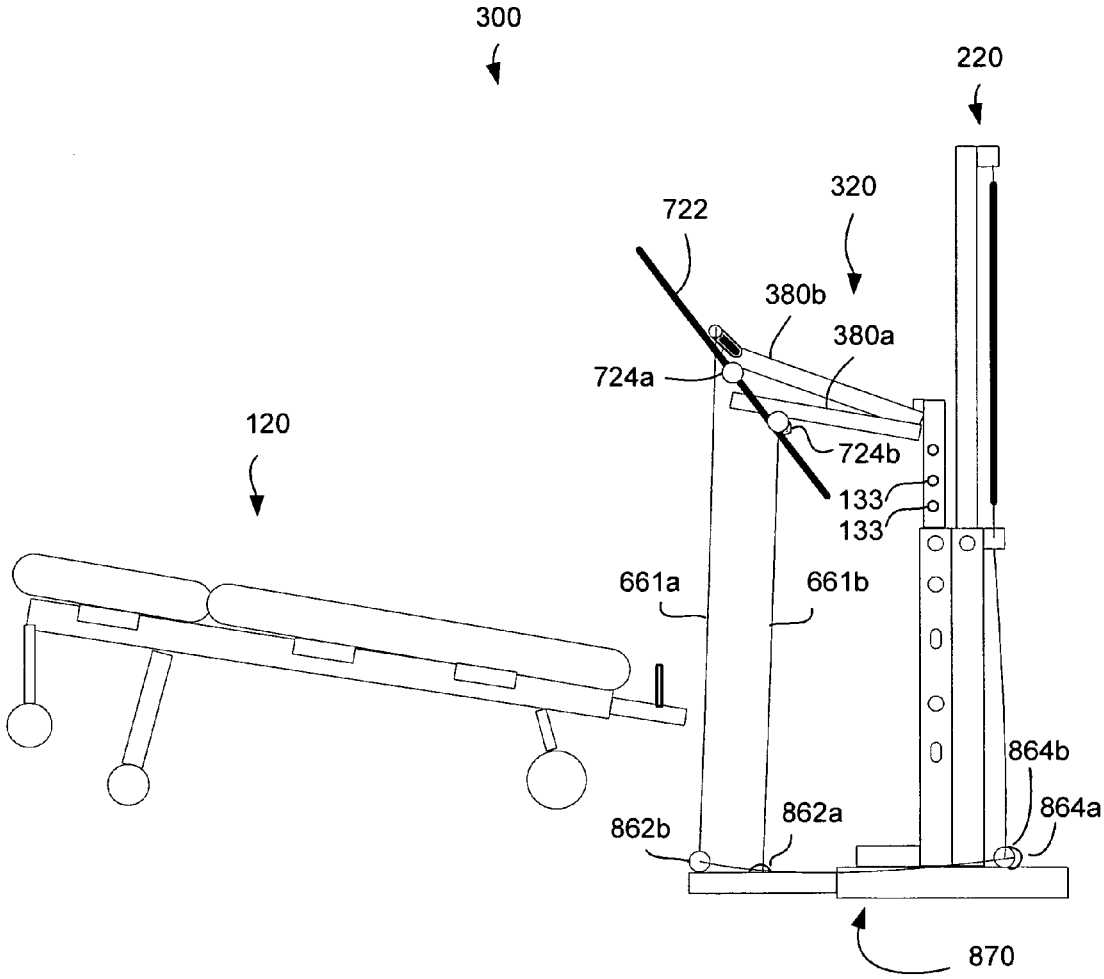
FIG. 7 illustrates a perspective view of the fitness apparatus of FIG. 3 with a squat bar attached to arms and a bench assembly detached from weigh-supporting frame.
Figure 10:
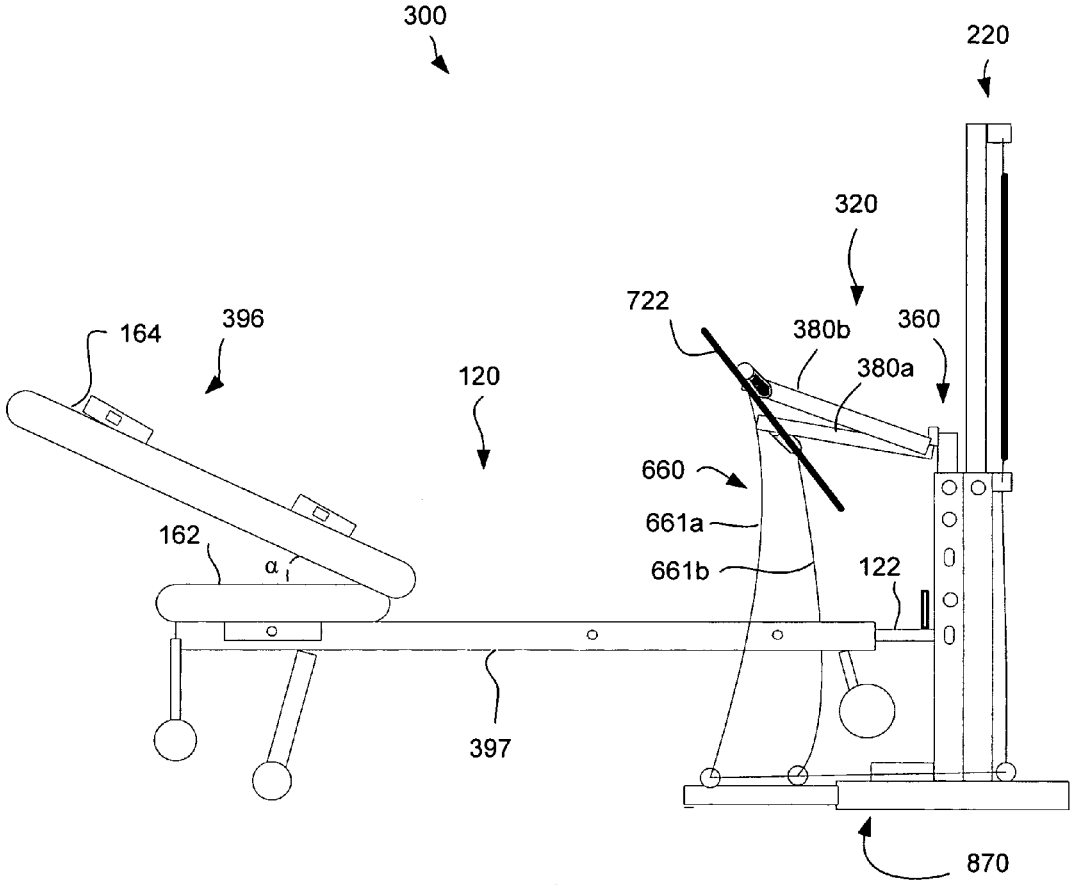
FIG. 10 illustrates a perspective view of the fitness apparatus of FIG. 6 with a rear pad leaning toward a front pad.
Figure 11:
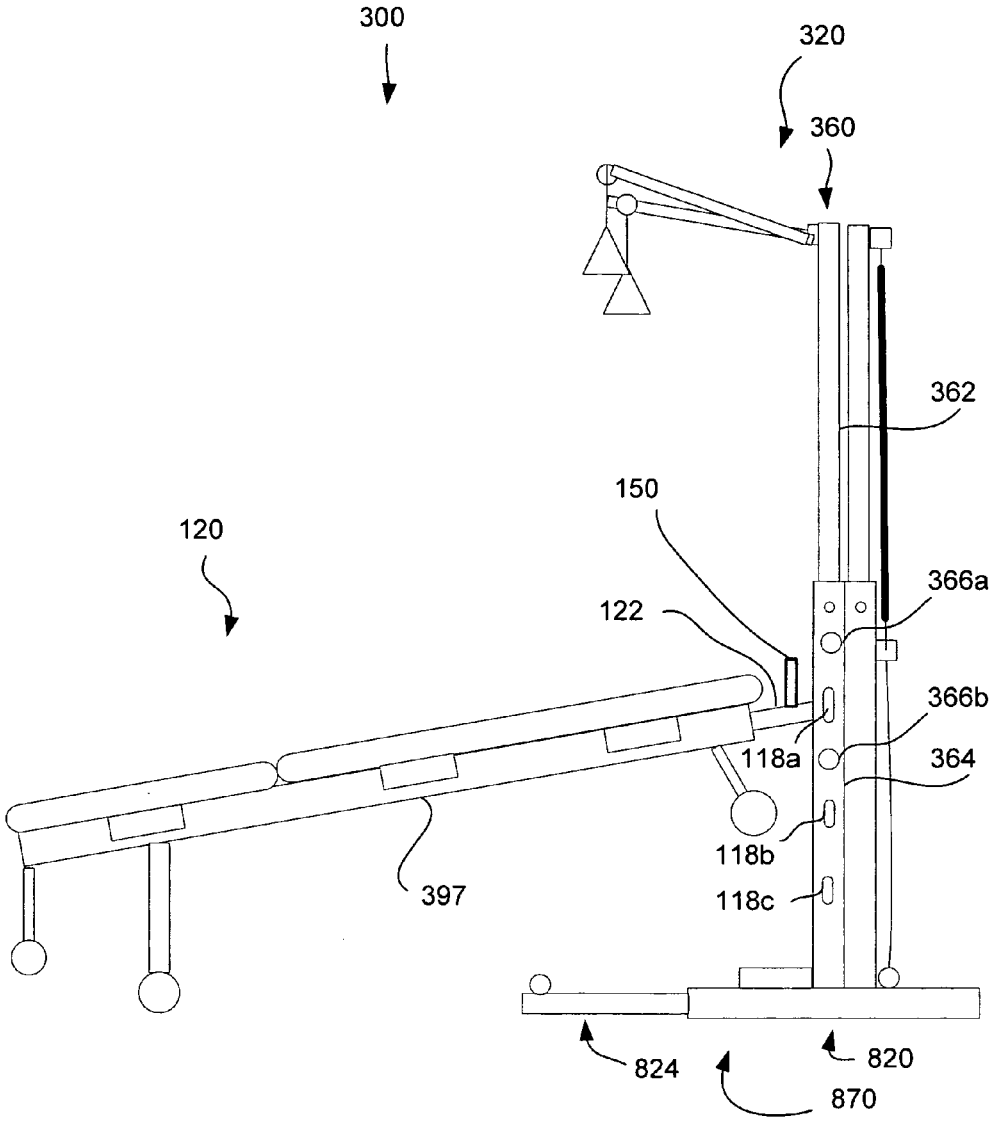
FIG. 11 illustrates a perspective view of the fitness apparatus of FIG. 1 with a bench assembly inclining upward against a weight-supporting frame of the fitness apparatus.
Figure 12:
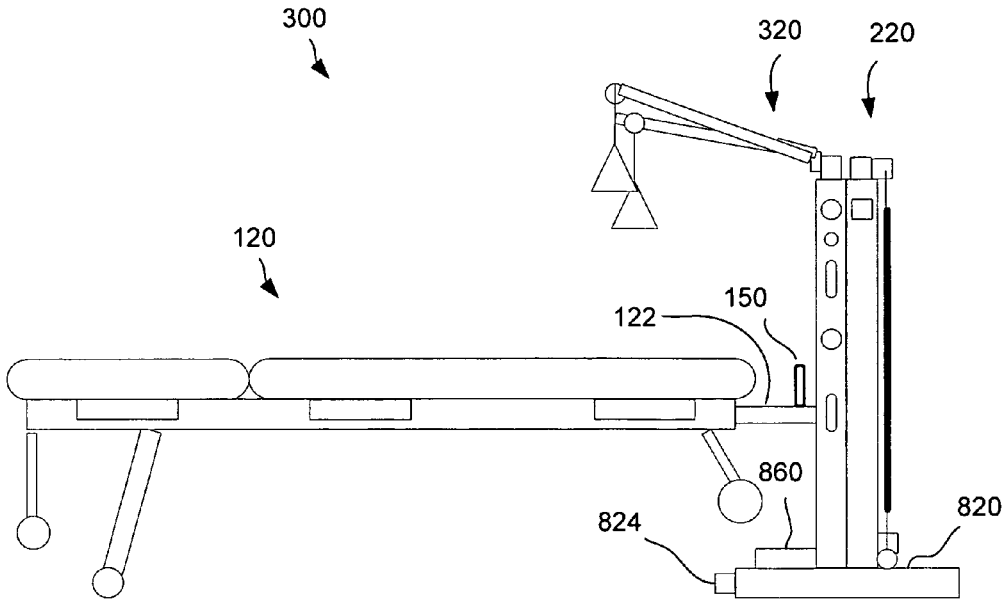
FIG. 12 illustrates a perspective view of the fitness apparatus of FIG. 1 with a weight-supporting frame, a supporting frame and a base in a storage position.

Upper support bar 362, configured to provide an adjustable height, has a plurality of coupling members 133 in a vertical arrangement formed on the body portion 358 thereof. Each coupling member is adapted for cooperating with a corresponding coupling member 135 that is formed on the body portion 372 of the lower holding bar 364. To adjust height, upper support bar 362 is moved up and/or down within lower holding bar 364 to a desired height and then affixed thereto by inserting locking pin 361 through coupling member 133 of upper support bar 362 and corresponding coupling member 135 of lower holding bar 364 (best shown in FIG. 3). This height-adjustability not only allows a user to flexibly configure the fitness apparatus to perform more than one exercising position, but also provide accommodations to the user of various heights (FIGS. 6, 7 and 10). Each coupling member 133 on the upper support bar 362 and corresponding coupling member 135 of lower holding bar 364 may be an aperture, a groove, a notch, a slot, or any combinations thereof.

Horizontal frame 340 has a body portion 344 defined by a first end portion 342*a* and an opposite, second end portion 342*b*. The body portion 344 of horizontal frame 340 is symmetrically mounted on about the top end portion 356 of upper support bar 362. Disposed on horizontal frame 340 is at least one arm tracks 346*a*, 346*b*. Arm tracks 346*a*, 346*b* extend horizontally and operably coupled to the pair of arms 380*a* and 380*b*. Arm tracks, 346*a*-346*b* allows the pair of arms 380*a* and 380*b* to move in the direction of arrow 302 in FIG. 3, thereby resulting in an adjustment of a distance between arms 380*a* and 380*b*. Preferably, arm tracks 346*a*-346*b* include a pair of arm tracks 346*a* and 346*b* arranged in a row and coupled to respective arm 380*a*-380*b* such that each arm 380*a*-380*b* is independently moveable within the corresponding arm track 346*a*-346*b*.

The pair of arms 380*a* and 380*b* has respective body portions 384*a* and 384*b*, of which each is defined by a front end portion 382*a* and a rear end portion 382*b*. Mounted to the rear end 382*b* of each arm 380*a*-380*b* is an arm-track coupling mechanism 490. Arm-track coupling mechanism 490 includes a pair of lodging members 484*a* and 484*b* and a linking member 486. Each lodging member 484*a*, 484*b* extend substantially parallel to and connected to the other lodging member 484*b*, 484*a* by linking member 486, which is perpendicular to the pair of lodging members 484*b* and 484*a* (FIG. 4). One (484*a*) of the pair of lodging members 484*a* and 484*b* of arm-track coupling mechanism 490 is attached perpendicularly to the rear end 382*b* of arms 380*a* and 380*b*.

Arm-track coupling mechanism 490 has dimensions suitable for inserting, moving and lodging arm within an arm track. For instance, lodging member 484*a* or 484*b* has a length, width and height in such that when in horizontal position, it enables an exercising user to insert arm 380*a* into arm track 346 or 346*b* and move arm 380*a* within arm track 346 or 346*b* in the direction of arrow 302 in FIG. 3. When in an upright position, lodging member 484 or 484*b* locks arm within arm track 346 or 346*b* through use of a locking pin 496, thereby affixing arm 380 or 380*b* onto horizontal frame 340. Although reference is made to coupling mechanism 490 that moveably connects arm 380 or 380*b* to arm track 346 or 346*b*, one skilled in the art may appreciate that other manners of coupling arm to corresponding arm track. For instance, and not by way of limitation, the coupling mechanism may be slip-fit, friction fit, releasable lock-fit, or otherwise moveably coupling arms to arm tracks using a means for moveably connecting one member to another member.

Figure 2A:
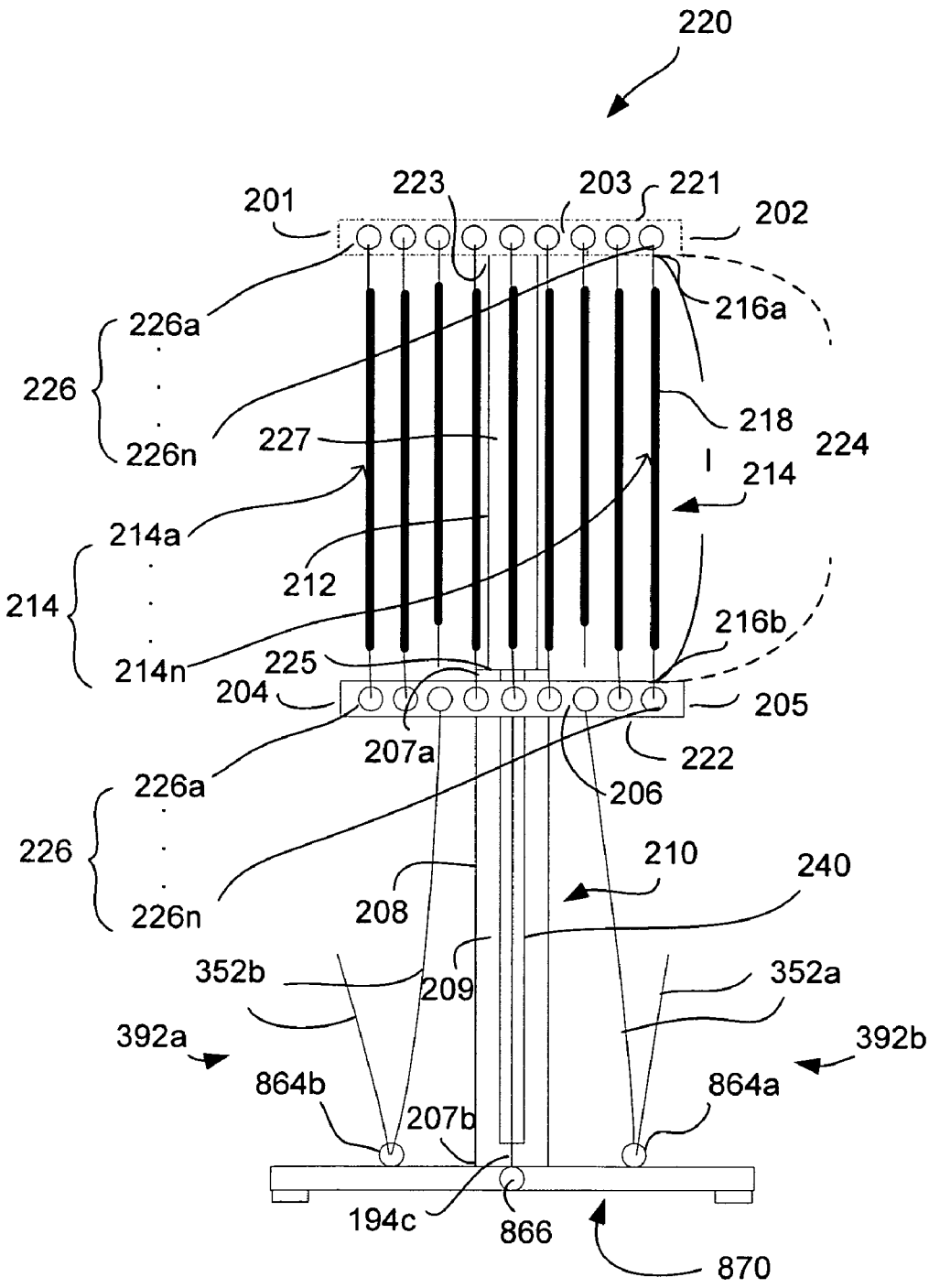
FIG. 2A illustrates a partial back view of the fitness apparatus of FIG. 1 showing a resistance assembly.
Figure 2B:
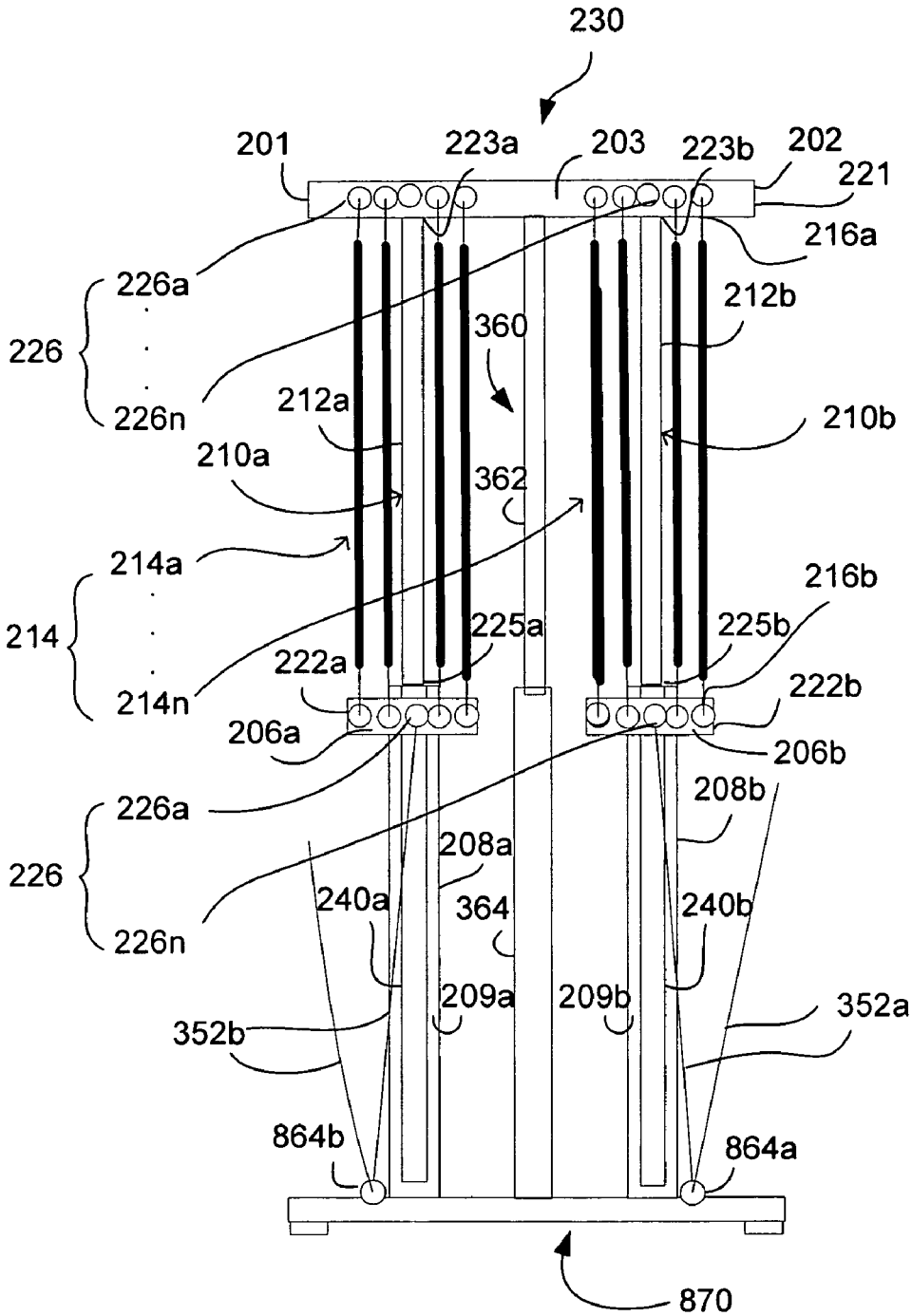
FIG. 2B illustrates a partial back view of a resistance assembly that includes a pair of resistance assemblies according to another aspect of the invention.

Connecting mechanism 392*a* or 392*b* in FIG. 2A is a cable and pulley system or assembly that couples one or more than one exercise mechanisms, e.g., exercise mechanisms 304, 306 and 722 to resistance assembly 620. Connecting mechanism 392*a*, 392*b* or 192*c* has at least one and preferably a plurality of cables and at least one and preferably a plurality of pulleys. In the embodiment shown, cables 352*a* and 352*b* extend from respective pulley stations 304*a* and 304*b* to respective pulley stations 862*a* and 862*b* and pass through respective locations on bottom spring attachment member 222 of resistance assembly 220. Pulley stations 305*a* and 305*b* are attached to the pair of arms 380*a* and 380*b*, and pulley stations 862*a* and 862*b* are mounted on base 870. Cable 194*c* couples to leg exercise mechanism 124 and passes through pulley station 866 on base 870 and then pass through bottom spring attachment member 222 of resistance assembly 220. Cables 661*a* and 661*b* extend from respective pulley stations 862*b* and 862*a* to corresponding pulley stations 864*b* and 864*a* on base 870 and passes through bottom spring attachment member 222 of resistance assembly 220. Cables of the present invention may be comprised of metallic material, rope, string, or other materials that are capable of functioning as described herein. Two ends of a cable may include a hook or any structure capable of coupling the cable to exercise mechanism and resistance assembly, respectively.

Each pulley station may include a pivoting member as a support. As a user moves exercise mechanism 124, for instance, the pivotal member moves to position pulley 866 so that cable 194*c* slides along pulley 866.

Disposed on arms 380*a* and 380*b* is first exercise mechanism 304*a* or 304*b*. The first exercise mechanism, here handles 304*a* and 304*b*, enables an exercising user to perform exercises using the user's arms. Handles 304*a* and 304*b* are coupled to cables 352*a* and 352*b*, respectively. The pivoting properties of pulley stations 301*a* and 301*b* enable the user to move handle 304*a* and 304*b* relative to weight-supporting frame 320, while cables 352*a* and 352*b* remain in engagement with respective pulleys 301*a*-301*b* located on arms 380*a* and 380*b* and pulleys 862*a*-862*b* located on base 780.

With continued reference to FIG. 6, mounted on arms 380*a* and 380*b* is second exercise mechanism 306*a* or 306*b* that is shown coupled to resistance assembly 620 through cables 661*a* or 661*b*. The second exercise mechanism, here handle bars 306*a* and 306*b*, enables an exercising user to perform arms and chest muscle exercises. At the two ends of cables 661*a*, 661*b* are hooks or other attachment members that detachably fasten cables to exercise mechanism and resistance assembly, respectively. The hooks allow cables 661*a* and 661*b* to be easily detached from second exercise mechanism, handle bars 306*a* and 306*b*, and connected with first exercise mechanism, handles 304*a* and 304*b*, and vice versa.

Referring now to FIG. 7, coupled to arms 380*a* and 380*b* is third exercise mechanism 722 that is shown coupled to resistance assembly 220 through cables 661*b*, 661*a*, and pulleys 862*a*, 862*b* and pulleys 864*a*, 864*b* located on base 870. The third exercise mechanism, here squat bar 722, enables an exercising user to perform straight squat exercises. Squat bar 722 is inserted into holding rings 724*a* and 724*b* that are mounted on body portions of respective arms 380*a* and 380*b*.

With continued reference to FIGS. 1-3, 7 and 11, coupled to base 870 is fourth exercise mechanism 390 that is shown mounted to bench assembly 120. The fourth exercise mechanism 390, here leg exercise mechanism, cooperates with resistance assembly 220 through cable 194*c* and pulley 866 located on base 870.

Figure 13:
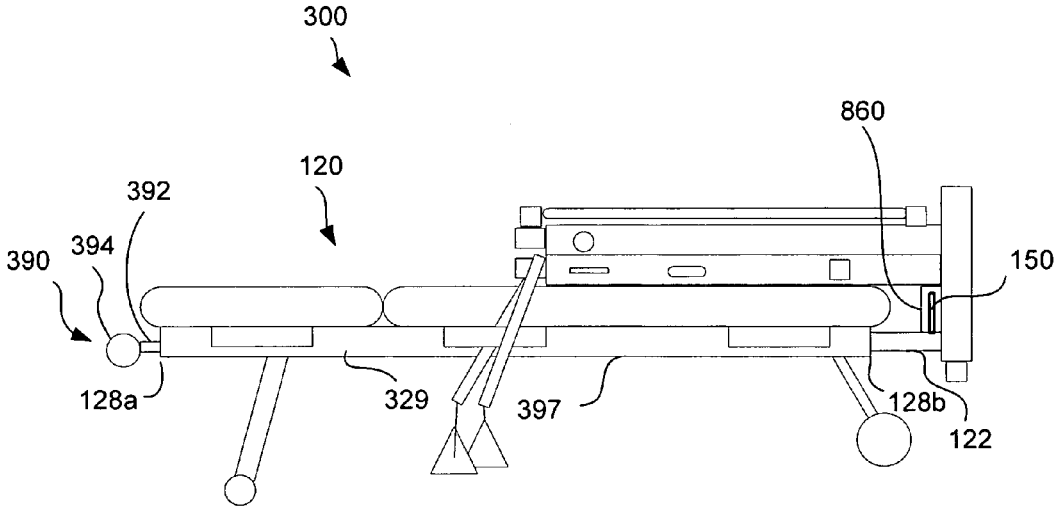
FIG. 13 illustrates a perspective view of the fitness apparatus of FIG. 12 with male and female connectors being coupled together.
Figure 14:
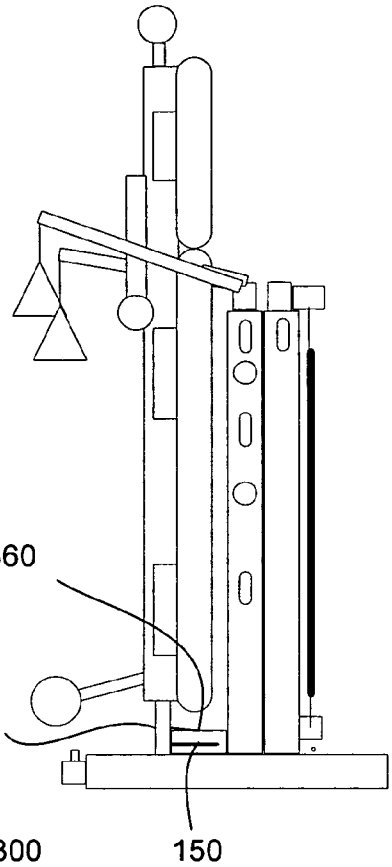
FIG. 14 illustrates a perspective view of the fitness apparatus of FIG. 13 in a standing storage position.
Figure 15:
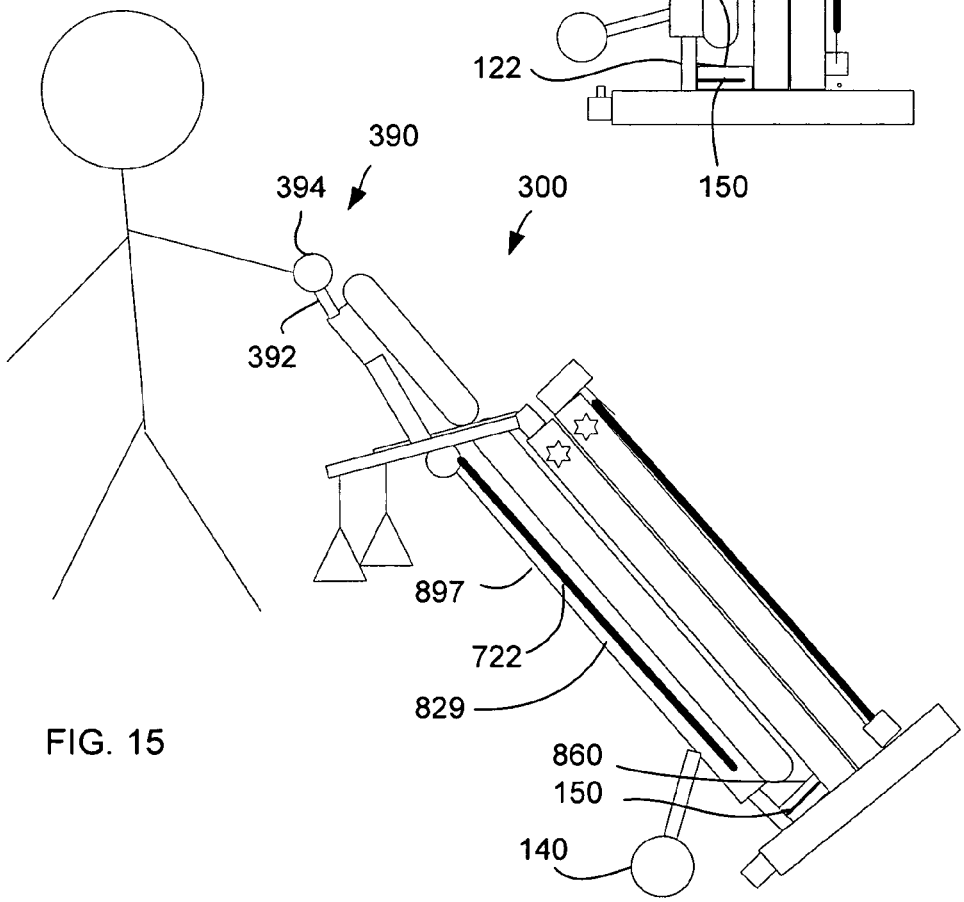
FIG. 15 illustrates a perspective view of the fitness apparatus of FIG. 14 showing the apparatus portable.

Resistance assembly 220 will now be described in additional details. As illustrated in FIG. 2A, supporting frame 210 of resistance assembly 220 includes upper resistance support 208 having a body portion 227 defined by a top end portion 223 and a bottom end portion 225, and lower resistance support 208 having a body portion 209 defined by a top end portion 207*a* and a bottom end portion 207*b*. Upper resistance support 212 is slidably coupled to lower resistance support 208. In one embodiment, the body portion 209 of lower resistance support is adapted for receiving upper resistance support 206 when fitness apparatus is not in use so that fitness apparatus may be easily moved or put away in a storage position, as shown in FIGS. 13-15.

Vertical track member 240 is mounted on lower resistance support 208 of supporting frame 210 of resistance assembly 220, extending vertically from about the top end portion 207*a* to about the bottom end portion 207*b* of lower resistance support 208.

Top spring-attachment member 221 has a body portion 203 defined by a first end portion 201 and an opposite, second end portion 202. Bottom spring-attachment member 222 has a body portion 206 defined by a first end portion 204 and an opposite, second end portion 205. Attached to top spring-attachment member 221 and bottom spring-attachment member 222 is resilient resistance member 214 having a body portion 218 with a body length of l defined by a top end portion 216*a* and a bottom end portion 216*b*.

Figure 2C:
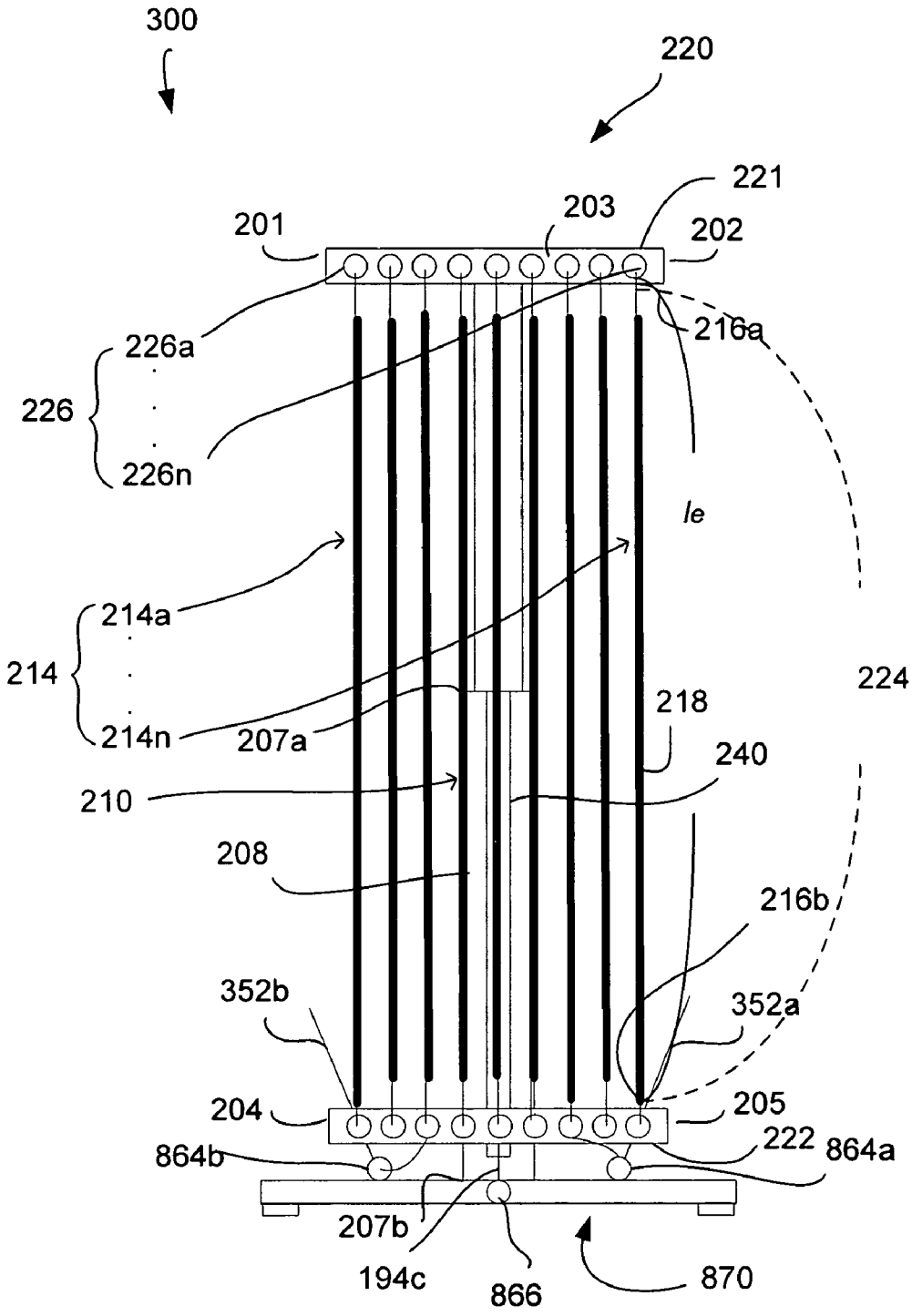
FIG. 2C illustrates a partial back view of the resistance assembly of FIG. 2A with springs being stretched as a bottom spring-attachment member moves down within a vertical track member.
Figure 2D:
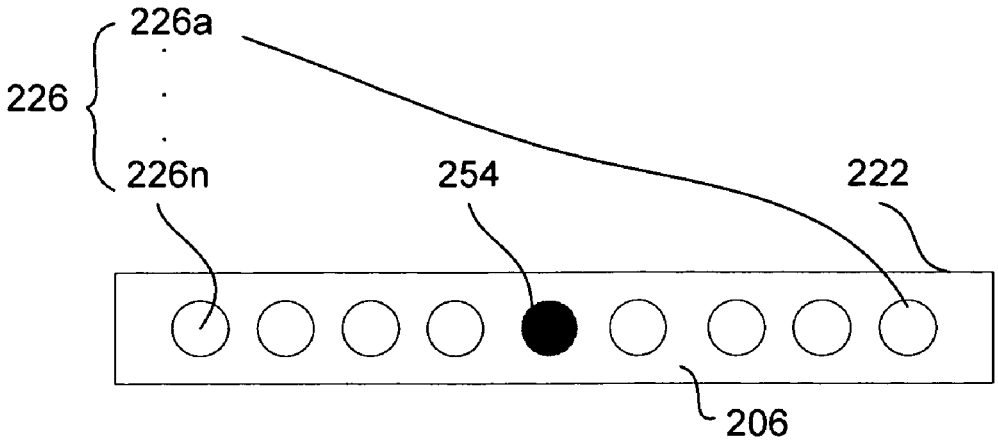
FIG. 2D illustrates a back view of a bottom spring-attachment member with a tracking ball connected thereto.
Figure 2E:
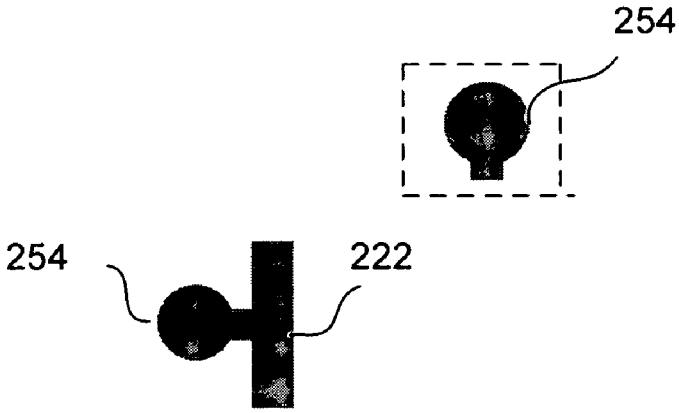
FIG. 2E illustrates a side view of the tracking ball of FIG. 2D.
Figure 2F:
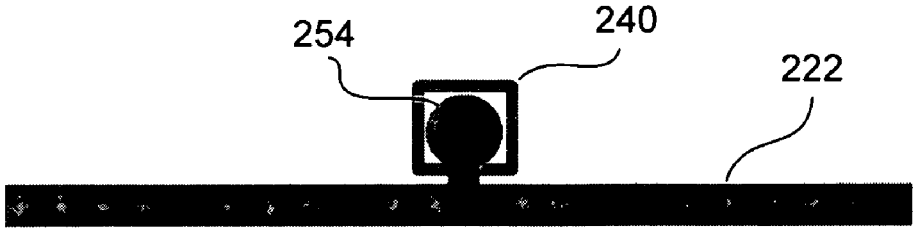
FIG. 2F illustrates a top view of the bottom spring-attachment member of FIG. 2D with the tracking ball in the vertical track member.

Bottom spring-attachment member 222*b* is movably coupled to vertical track member 240 through coupling mechanism 254 and cooperates with exercise mechanisms 104, 124, 640 and 722 such that a movement of exercise mechanisms 104, 124, 640 and 722 moves bottom spring-attachment member 222*b* within vertical track member 240 in the direction of arrow 290 in FIG. 2C. Coupling mechanism 254 is adapted for moving up and down within vertical track member 240 such that the bottom spring-attachment member 222 moves accordingly. Coupling mechanism has a ball-like structure 254 symmetrically mounted on the body portion 206 of bottom spring-attachment member 222. A means for coupling bottom spring-attachment member 222*b* to vertical track member 240 includes, but not limited by, the ball-like structure 254. One skilled in the art may appreciate that any other means, structures or configurations that can perform the functions described herein may also be used.

On the body portion 203 and 206 of each spring-attachment member 221-222 has at least one attachment mechanism 226 that enables the end portions 216*a*-216*b* of the resilient resistance member 214 to be affixed thereto. Preferably, there are a plurality of attachment mechanisms 226*a*-226*n* formed on the body portion 203 and 206 of each spring-attachment member 221-222. Attachment mechanisms 226*a*-226*n* may be one of an aperture, a groove, a notch, a slot or any combinations thereof.

Resilient resistance members 214*a*-214*n*, such as springs, are adapted to provide resistance to the motion of bottom spring-attachment member 222*b* as a user pulls on one or more of cables 194*a*-194*c* (FIG. 1) connected to pulley stations 254*a*-254*c*, respectively. In one configuration, a top end 216*a* of each resistance member 214*a*-214*n* is coupled to top spring-attachment member 222*a*, and a bottom end 216*b* thereof coupled to bottom spring-attachment member 222*b*, while connecting member 250 may move a bottom end 216*b* of each resistance member 254*a*-254*c* as bottom spring attachment member 222*b* moves within vertical track member 240. As bottom spring-attachment member 222 moves down vertical track member 240, when cables 194*a*-194*b* are pulled downward or when cable 194*c* is pushed forward (FIG.

1), the body length l of each resistance member 214*a*-214*n* is extended, such as depicted in FIG. 2C. With each resistance member 214*a*-214*n* being resilient, the resiliency characteristics of each resistance member 214*a*-214*n* allow connecting members 192*a*-192*c* to extend each resistance member 214*a*-214*n* under the force exerted by a user using fitness apparatus 200, shown in the partial view of exercise device 200 depicted in FIG. 2C. The resilient characteristics of each resistance member 214*a*-214*n*, however, enable each resistance member 214*a*-214*n* to return to its configuration prior to being extended by the force exerted by the exercising user, as is depicted in FIG. 2A.

A choice of a number of resistance member 214*a*-214*n* being coupled to corresponding apertures 226*a*-226*n* selectively adjusts the amount of resistance applied by resistance assembly 200 to the movement of the exercise mechanisms 104, 124, 640 and 722. The number of resistance member 214*a*-214*n* being coupled to corresponding apertures 226*a*-226*n* on spring attachment member 220 defines a different resistance level. By varying the number of resistance member 214*a*-214*n* coupled to corresponding apertures 226*a*-226*n*, it is provided a fitness apparatus that has a small incremental change in the resistance level from one resistance member to two resistance members or a fitness apparatus that has a large incremental change in the resistance level from one resistance member to another. In this manner, the present invention provides fitness apparatuses that may be configured to provide numerous various incremental steps of resistance level.

Resistance member 214*a*-214*n* may be arranged in various configurations so long as they are capable of being temporarily stretched or lengthened under application of a force from a resting configuration (FIG. 2A), while substantially returning to the resting configuration following stretching or lengthening to the tense configuration (FIG. 2C). Illustratively, resistance member 214*a*-214*n* may be springs, elastomeric members (e.g., bone shaped rubber bands), or other materials or structures having sufficient resiliency. Springs that are available on the market come with various resistances. For instance, the diameter of compression springs can vary according to desired resistance. The diameter can vary within an individual compression spring as well, such as in hourglass, conical and barrel compression springs. The spacing of the coils (pitch) can be varied and customized too, in order to provide even more exact resistance. Typically, compression springs are placed over a rod or fitted inside of a hole.

In one embodiment, fitness apparatus may have a resistance assembly 230 that has (i) a pair of supporting frames 210*a* and 210*b*; (ii) a pair of bottom spring-attachment members 222*a* and 222*b*; and (iii) a plurality of resilient resistance members 214*a*-214*n*, shown in the partial view of fitness apparatus 200 depicted in FIG. 2B. Within the pair, each supporting frame 210*a*, 210*b* extends substantially parallel to and spaced apart from the other supporting frame 210*b*-210*a*, and each bottom spring-attachment member 222*a*, 222*b* moveably couples to respective vertical track member 240*a*, 240*b*. In addition, each resilient resistance member is detachably affixed to top spring-attachment member 221 and respective bottom spring-attachment member 222*a*, 222*b*. Moreover, top spring-attachment member 221 is symmetrically mounted on the respective top end portions 223*a* and 223*b* of the corresponding upper resistance supports 212*a* and 212*b*. This particular design enables a user to exercise left and right arms separately.

In this embodiment, the ends of cables 352*a* and 352*b* that couple to first exercise mechanism, handles 304*a* and 304*b*, may also be used to couple to leg exercise mechanism 390 by detaching the cable's attachment ends from first exercise mechanism, handles 304*a* and 304*b*, to leg exercise mechanism 390, and vice versa.

Optionally, vertical frame 360 may have at least one foot-holder 366*a*, 366*b* mounted on lower holding bar 364. The at least one foot-holder 366*a*, 366*b* extends horizontally and adapted for anchoring a user's feet as the user does a sit-up exercise (FIG. 3). Preferably, lower holding frame 364 has at least two foot-holders 366*a*, 366*b* and 367*a*, 367*b* extending substantially parallel to and spaced apart from each other. More preferably, each foot-holder has a pair of horizontal bars 366*a* and 366*b* (or 367*a* and 367*b*), of which each horizontal bar 366*a*, 366*b* (or 367*a*, 367*b*) is mounted to lower holding frame 364 and extends substantially parallel to and spaced apart from the other horizontal bar 366*b*, 366*a* (or 367*a*, 367*b*) by lower holding frame 364.

With continued reference to FIGS. 1-3 and 13, a fitness apparatus according to one embodiment of the invention has a bench assembly 120 that moveably and detachably couples to lower holding bar 364 of vertical frame 360 of weight-supporting frame 320. Bench assembly 120 includes (i) an elongate bench frame 397 having a body portion 129 defined by a front end portion 128*a* and a rear end portion 128*b*, and the body portion 129 has a top surface 399*a* and a bottom surface 399*b*; (ii) a frame-connecting member 122 mounted to the rear end portion 128*b* of the elongate bench frame 397 and adapted for moveably and detachably connecting the elongate bench frame 397 to the lower holding bar 364 of the vertical frame 360; and (iii) a seat pad 396 moveably and detachably coupled to the top surface 399*a* of the elongate bench frame 397.

Mounted on bottom surface 399*b* of the front end portion 128*a* of elongate bench frame 397 is a leg exercising mechanism 390 that has leg lever 394 and leg support 392 (best shown in FIG. 3). Leg support 392 extends substantially perpendicular to leg lever 394 and flexibly couples to the bottom surface 399*b* of the front end portion 128*a* of elongate bench frame 397. The leg lever 394 couples to resistance assembly 220 by cable 194*c* (FIG. 1) or cable 252*c* in FIG. 2 and pulley station 866. Moreover, the front end portion 128*a* of elongate bench frame 397 is adapted for receiving and engaging leg support 392 of leg exercising mechanism 390 when leg exercising mechanism 390 is in a storage position.

Also operably coupled to the bottom surface 399*b* adjacent to the rear end portion 128*b* of elongate bench frame 397 is a wheel 140. This wheel 140 allows a user to easily move fitness apparatus 300 around while holding on leg lever 394 of leg exercising mechanism 390 in a storage position, as depicted in FIG. 15, where straight squat bar 722 is stored alongside elongate bench frame 397.

Elongate bench frame 126 is coupled to lower holding bar 364 of vertical frame 360 through bench-frame connecting member 122. Formed on the body portion 372 of lower holding bar 364 is at least one frame-connecting-member receiver 118*a*-118*c* that is adapted for enabling the frame-connecting member 122 to be affixed thereto. Preferably, lower holding bar 364 has at least three frame-connecting-member receivers 118*a*-118*c* spaced apart vertically. This allows elongate bench frame 126 to be disposed horizontally or to incline at an angle in relation to a surface upon which exercise device 300 is disposed. As shown in fitness apparatus 300 depicted in FIGS. 7 and 11, respectively, bench frame connecting member 122 detachably couples to one of receivers 118*a*-118*c* on vertical frame 360. It can detach from vertical frame 360 to make room for a user performing straight squat exercises (FIG. 7) or incline upwards by attaching to one of receivers 118*a*-118*c* at a relatively higher level such that the user may perform sit-up exercises (FIG. 1) while having his or her feet anchored to corresponding foot-holders 366*a* and 366*b* (FIG. 3). Frame-connecting-member receiver 118*a*-118*c* may be one of an aperture, a groove, a notch, a slot or any combinations thereof. Furthermore, bench frame connecting member 122 may be secured to receiver 118*a*-118*c* through use of locking pin 363-365 (FIG. 3), respectively.

Mounted on a top of and forming a vertical angle with bench-frame connecting member 122 is a male connector 150. This male connector 150 is adapted for connecting with a female connector on base 870, which allows elongate bench frame 397 to be placed in a storage position, as shown in fitness apparatus 300 depicted in FIG. 13.

Cooperating with elongate bench frame 397 is a seat pad 396 upon which a user may sit or incline as he or she uses exercise mechanisms 304*a*-304*b*, 306*a*-306*b*, 722 and/or 390. Seat pad 396 may be coupled to elongate bench frame 126 through use of a coupling member 103*a*-103*c* including but not limited to clips, pins, screws or any other suitable structure that can perform the functions described herein.

Figure 5:
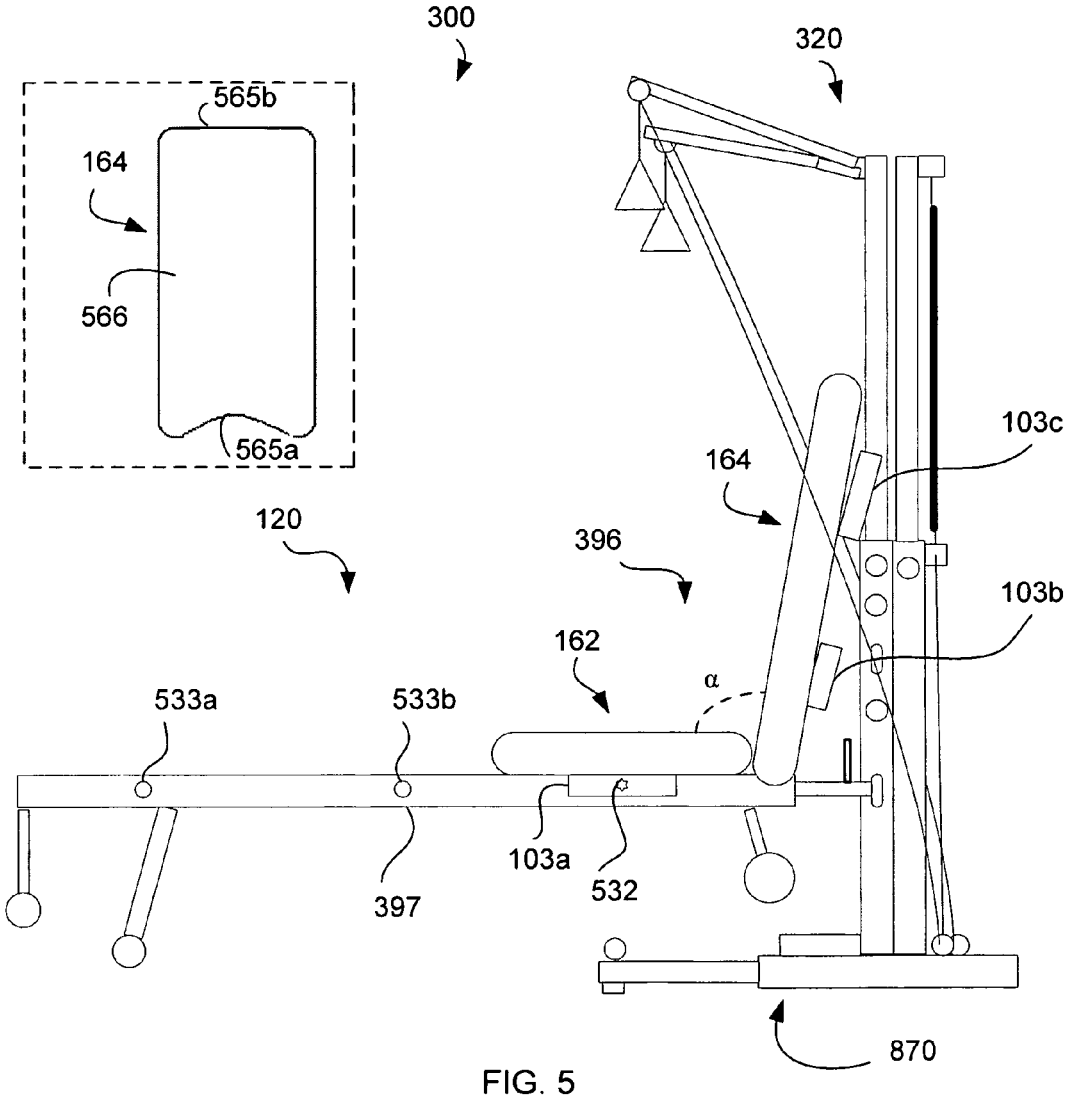
FIG. 5 illustrates a perspective view of the fitness apparatus of FIG. 1 showing a seat pad being pushed backward with a rear seat pad leaning against a weight-supporting frame in an inclined position. The inset shows a front view of the rear seat pad.

With continued reference to FIGS. 5, 7 and 10, seat pad 396 includes front seat pad 162 and rear seat pad 164 that operably couples to front seat pad 162. Seat pad 396 may be slidably positioned upon elongate bench frame 397 to accommodate an user sitting in various exercise positions. For instance, rear seat pad 164 may incline at an angle of between 0 and 180 degrees relative to front seat pad 162 for a sitting exercise position (FIG. 5), in which rear seat pad 164 is used as a backrest, or for a straight squat exercise position (FIG. 10), in which rear pad 164 leans toward front pad 162 to make more room for an exercising user without removing bench assembly 120 from vertical frame 360. Doing so is more stable than having bench assembly 120 detached from weight-supporting frame 320 while a user is performing straight squat exercises (FIG. 7). Rear seat pad 164 has a body portion 566 defined by a front end 565*a* and a rear end 565*b*. Front end 565*a* of rear seat pad 164 is depicted as having a substantially concave profile adapted for operbly coupling to front seat pad 162, as depicted in FIG. 5 inset. However, one skilled in the art may appreciate that front end 565*a* of rear seat pad 164 may have various other configurations to perform the functions described herein.

Figure 8:
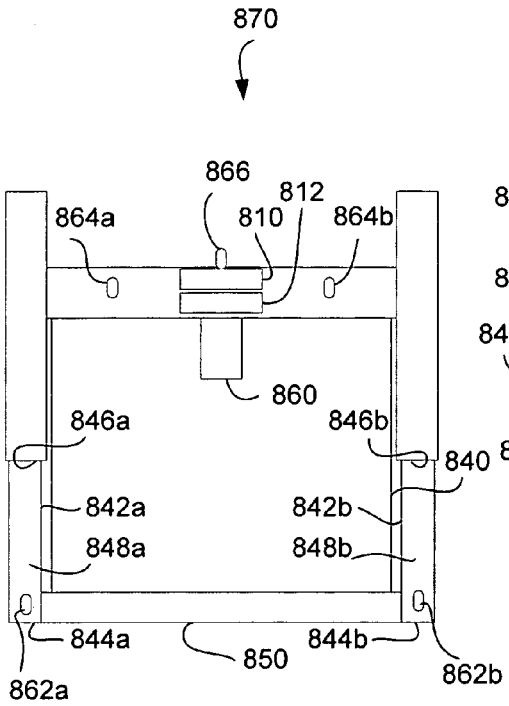
FIG. 8 illustrates a top view of a base in accordance with one embodiment of the present invention with a pull-out rail extended.
Figure 9:
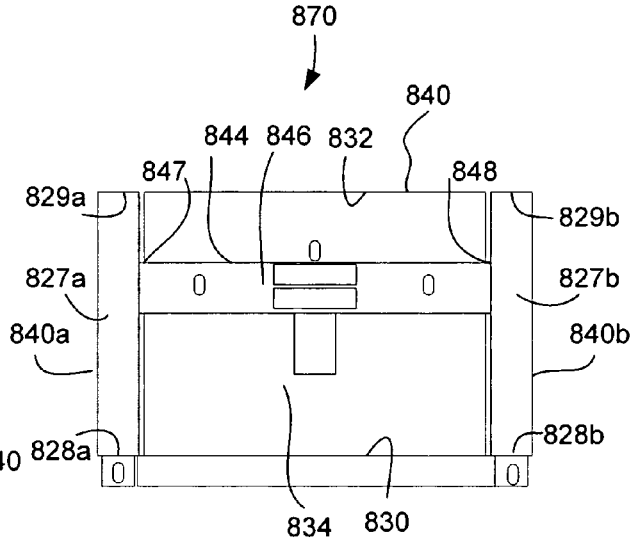
FIG. 9 illustrates a top view of the base of FIG. 8 with a pull-out rail retracted.

With continued reference to FIGS. 8-9, base 870 has (i) a pair of parallel support bars 840*a* and 840*b*; (ii) a connecting bar 844 connecting the pair of support bars 840*a* and 840*b* and forming a vertical angle with each support bar 840*a*, 840*b*; (iii) a pair of pull-out bars 842*a* and 842*b* slidably attached to the respective support bars 840*a* and 840*b*; (iv) a pull-out-bar connector 850 connecting pull-out bars 842*a* and 842*b* and forming a vertical angle with each pull-out bar 842*a*, 842*b*; and (v) a platform 880 attached to pull-out bar connector 850.

Each support bar 840*a*-840*b* has a body portion 827*a*-827*b* defined by a front end portion 828 and a rear end portion 829. Connecting bar has a body portion 846 defined by a first end portion 847*a* and an opposite, second end portion 848*b*. The first and second end portions 847*a*, 848*b* of connecting bar 844 are connected to respective body portions 827*a* and 827*b* of support bars 840*a*, 840*b*. Disposed on connecting bar 844 are receptacles 810 and 812 that are adapted for holding resistance assembly 220 and weight-supporting frame 320, respectively. Mounted on a side of body portion of connecting bar 844 facing toward frond end of base 870 is female connector 860 adapted for receiving male connector 150.

Each pull-out bar 842*a*, 842*b* extends parallel to and spaced apart from the other pull-out bar 842*b*-842*a* and has a body portion 848*a*, 848*b* defined by a front end portion 844*a*-844*b* and a rear end portion 846*a*-846*b*. Pull-out-bar connector 850 connects the front end portions of the pair of pull-out bars 842*a* and 842*b*. Platform 880 has a body portion 834 defined by a front end portion 830 and rear end portion 832. The front end portion 830 of platform 880 is attached to pull-out bar connector 850 such that a movement of the pair of pull-out bars 842*a* and 842*b* simultaneously moves platform 880.

Each pull-out bar 842*a*, 842*b* extends substantially parallel to and spaced apart from the other pull-out bar 842*a*, 842*b* by connecting bar 844, and slidably couples to a corresponding support bar 832*a*, 832*b* such that it can slide in and out of corresponding support bar 832*a*, 832*b*. Although reference is made to extendable base 870, one skilled in the art may appreciate that extendable base 870 may have various other configurations to perform the functions described herein.

Mounted onto front end portions of pull-out bars 842*a* and 842*b* are pulleys 862*a* and 862*b*, respectively. Pulleys 862*a* and 862*b* are substantially parallel to and spaced apart with a distance, preferably with a distance no shorter than a body length $l_c$ of connecting bar 844. Two additional pulleys 864*a* and 864*b* are disposed on a top of body portion of connecting bar 844, of which each pulley 864*a*, 864*b* extends substantially parallel to and spaced apart from the other pulley 864*a*, 864*b* with receptacles 810 and 812 in-between. Mounted on a side of body portion of connecting bar 826 posterior to receptacle 810 is pulley 866.

Passing through pulley 866 is cable 194*c*. Passing through pulleys 864*b* and 864*a* are cables 304*a* and 304*b*, respectively, passing through pulleys 862*b* and 864*b* are cables 661*a*, and passing through pulleys 862*a* and 864*b* are cables 661*b*.

Female connector 860 is adapted for coupling with male connector 150 such that bench assembly 120 may be affixed to base 870 when fitness apparatus 300 is ready to be moved or placed for storage, such as depicted in FIGS. 13-15.

In summary, the present invention, among other things, provides a multi-purpose fitness apparatus that allows a user to selectively adjust resistance and to perform multiple exercising positions and is flexible, compact, portable and user-friendly.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A resistance assembly for a fitness apparatus, comprising:

a. a base;

b. a supporting frame vertically mounted on the base, the supporting frame including a lower resistance support and an upper resistance support that is slidably coupled to the lower resistance support, wherein the upper resistance support has a body portion defined by a top end portion and a bottom end portion, and the lower resistance support has a body portion defined by a top end portion and a bottom end portion;

c. a vertical track member mounted on the lower resistance support of the supporting frame, the vertical track member extending vertically from about the top end portion to about the bottom end portion of the lower resistance support;

d. a top spring-attachment member having a body portion defined by a first end portion and an opposite, second end portion, the body portion extending horizontally and mounted on about the top end portion of the upper resistance support;

e. a bottom spring-attachment member having a body portion defined by a first end portion and an opposite, second end portion, the bottom spring-attachment member extending substantially parallel to and spaced apart from the top spring-attachment member and moveably coupled to the vertical track member such that a movement of the bottom spring-attachment member occurs within the vertical track member; and f. a resilient resistance member having a body portion with a body length of l defined by a top end portion and a bottom end portion, the resilient resistance member extending substantially vertical to and detachably affixed to the top and bottom spring-attachment members, respectively.

2. The resistance assembly of claim 1, wherein the supporting frame is detachably mounted on the base.

3. The resistance assembly of claim 1, wherein the body portion of the lower resistance support is adapted for enabling the upper resistance support to slide into and lodge therein.

4. The resistance assembly of claim 1, wherein each spring-attachment member has at least one attachment mechanism formed on the respective body portion thereof, the attachment mechanism being adapted for enabling the end portions of the resilient resistance member to be affixed thereto.

5. The resistance assembly of claim 4, wherein the at least one attachment mechanism is one of an aperture, a groove, a notch and a slot.

6. The resistance assembly of claim 4, wherein each end portion of the resilient resistance member comprises a hook adapted for detachably affixing the resilient resistance member to the at least one attachment mechanism of the spring-attachment member.

7. The resistance assembly of claim 1, wherein the resilient resistance member comprises a plurality of resistance members such that a choice of a number of the resistance member affixed to the top and bottom spring-attachment members selectively adjusts an amount of resistance being applied to the movement of the bottom spring-attachment member.

8. The resistance assembly of claim 1, wherein the body length l of the resilient resistance member is stretched as the bottom spring-attachment member moves downward within the vertical track member, and is recovered when the bottom spring-attachment member returns to a starting location.

9. The resistance assembly of claim 1, wherein the bottom spring-attachment member comprises a coupling mechanism adapted for moving up and down within the vertical track member such that the bottom spring-attachment member moves accordingly.

10. The resistance assembly of claim 9, wherein the coupling mechanism comprises a ball-like structure mounted on the body portion of the bottom spring-attachment member in such that the end portions of the bottom spring-attachment member are symmetrical with respect to the ball-like structure.

11. The resistance assembly of claim 1, wherein the resilient resistance member comprises at least one of an elastomeric member and a spring.

12. The resistance assembly of claim 1, wherein the resistance assembly comprises:

a. a pair of supporting frames, each supporting frame extending substantially parallel to and spaced apart from the other supporting frame;

b. a pair of bottom spring-attachment members, each bottom spring-attachment member being moveably coupled to the respective vertical track member; and c. a plurality of resilient resistance members, each resilient resistance member being detachably affixed to the top spring-attachment member and the respective bottom spring-attachment member;

wherein the top spring-attachment member is symmetrically mounted on the respective upper resistance supports of the pair of supporting frames.

13. The resistance assembly of claim 12, wherein each supporting frame is detachably mounted on the base.

14. The resistance assembly of claim 12, wherein the body portion of each lower resistance support is adapted for enabling the corresponding upper resistance support to slide into and lodge therein.

15. The resistance assembly of claim 12, wherein the top spring-attachment member has a plurality of attachment mechanisms, and each bottom spring-attachment member has at least one corresponding attachment mechanism, which are formed on the respective body portions of the top and bottom spring-attachment members, and wherein the attachment mechanisms is adapted for enabling the end portions of the resilient resistance member to be affixed thereto.

16. The resistance assembly of claim 15, wherein the attachment mechanism is one of an aperture, a groove, a notch and a slot.

17. The resistance assembly of claim 15, wherein each end portion of the resilient resistance member comprises a hook adapted for detachably affixing the resilient resistance member to the corresponding attachment mechanisms on the top and respective bottom spring-attachment members.

18. The resistance assembly of claim 1, wherein each bottom spring-attachment member comprises a coupling mechanism being adapted for moving up and down within the respective vertical track member such that the bottom spring-attachment member move accordingly.

19. The resistance assembly of claim 18, wherein the coupling mechanism comprises a ball-like structure mounted on the body portion of the corresponding bottom spring-attachment member in such that the end portions of the corresponding bottom spring-attachment member are symmetrical with respect to the ball-like structure.

20. A multi-purpose fitness apparatus, comprising:

a. a base;

b. a weight-supporting frame vertically mounted on the base;

c. at least one exercise mechanism coupled to the weight-supporting frame;

d. a resistance assembly for providing adjustable resistance, the resistance assembly vertically mounted on the base and located posterior to the weight-supporting frame; and e. a connecting mechanism coupling the exercise mechanism to the resistance assembly such that a movement of the exercise mechanism is resisted by a resistance provided by the resistance assembly;

wherein the resistance assembly comprises:

(i) a supporting frame vertically mounted on the base 870, the supporting frame including a lower resistance support and an upper resistance support that is slidably coupled to the lower resistance support, wherein the upper resistance support has a body portion defined by a top end portion and a bottom end portion, and the lower resistance support has a body portion defined by a top end portion and a bottom end portion;

(ii) a vertical track member mounted on the lower resistance support of the supporting frame, the vertical track member extending vertically from about the top end portion to about the bottom end portion of the lower resistance support;

(iii). a top spring-attachment member having a body portion defined by a first end portion and an opposite, second end portion, the body portion extending horizontally and mounted on about the top end portion of the upper resistance support;

(iv). a bottom spring-attachment member having a body portion defined by a first end portion and an opposite, second end portion, the bottom spring-attachment member extending substantially parallel to and spaced apart from the top spring-attachment member and moveably coupled to the vertical track member such that a movement of the bottom spring-attachment member occurs within the vertical track member; and (v). a resilient resistance member 4 having a body portion with a body length of l defined by a top end portion and a bottom end portion, the resilient resistance member extending substantially vertical to and detachably affixed to the top and bottom spring-attachment members, respectively.

21. The multi-purpose fitness apparatus of claim 20, wherein the weight-supporting frame further comprises:

a. a vertical frame vertically mounted on the base and having a lower holding bar and an upper support bar that is slidably coupled to the lower holding bar, the upper support bar having a body portion defined by a top end portion and a bottom end portion, and the lower holding bar having a body portion defined by a top end portion and a bottom end portion;

b. a horizontal frame having a body portion defined by a first end portion and an opposite, second end portion, the body portion of the horizontal frame being symmetrically mounted onto the top end portion of the upper support bar; and c. a pair of arms having respective body portions, of which each being defined by a front end portion and a rear end portion, each arm being coupled to the horizontal frame and extending symmetrical to the other arm with respect to the vertical frame.

22. The multi-purpose fitness apparatus of claim 21, wherein the bottom end portion of the lower holding bar is detachably mounted on the base.

23. The multi-purpose fitness apparatus of claim 21, wherein the upper support bar comprises a plurality of coupling members in a vertical arrangement formed on the body portion thereof, each coupling member being adapted for cooperating with a corresponding coupling member formed on the body portion of the lower holding bar.

24. The multi-purpose fitness apparatus of claim 23, wherein each coupling member on the upper support bar is one of an aperture, a groove, a notch and a slot.

25. The multi-purpose fitness apparatus of claim 21, wherein the horizontal frame further comprises an arm track extending horizontally and operably coupled to the pair of arms such that the pair of arms are moveable within the arm track, thereby resulting in an adjustment of a distance between the pair of arms.

26. The multi-purpose fitness apparatus of claim 21, wherein the arm track comprises a pair of arm tracks, each arm track spaced apart from the other arm track and coupled to the respective arm such that each arm is independently moveable within the corresponding arm track, thereby resulting in an adjustment of a distance between the pair of arms.

27. The multi-purpose fitness apparatus of claim 25, wherein the arm track is coupled to each arm through an arm-track coupling mechanism mounted to the rear end of each arm.

28. The multi-purpose fitness apparatus of claim 20, wherein the resistance assembly comprises:

a. a pair of supporting frames, each supporting frame extending substantially parallel to and spaced apart from the other supporting frame;

b. a pair of bottom spring-attachment members, each bottom spring-attachment member being moveably coupled to the respective vertical track member; and c. a plurality of resilient resistance members, each resilient resistance member being detachably affixed to the top spring-attachment member and the respective bottom spring-attachment member;

wherein the top spring-attachment member is symmetrically mounted on the respective top end portions of the corresponding upper resistance supports.

29. The multi-purpose fitness apparatus of claim 28, wherein each bottom spring-attachment member has at least one and the top spring-attachment member has a plurality of attachment mechanisms formed on the respective body portions thereof, the attachment mechanism being adapted for enabling the end portion of the resilient resistance member to be affixed thereto.

30. The multi-purpose fitness apparatus of claim 29, wherein the attachment mechanism is one of an aperture, a groove, a notch and a slot.

31. The multi-purpose fitness apparatus of claim 28, wherein each bottom spring-attachment member comprises a respective coupling mechanism being adapted for moving up and down within the respective vertical track member such that the bottom spring-attachment member moves accordingly.

32. The multi-purpose fitness apparatus of claim 20, wherein the exercise mechanism is one of a handle pull down mechanism, a handle bar and a squat bar.

33. The multi-purpose fitness apparatus of claim 20, wherein the connecting mechanism comprises a cable and a pulley.

34. The multi-purpose fitness apparatus of claim 21, further comprising a bench assembly moveably and detachably coupled to the lower holding bar of the vertical frame of the weight-supporting frame.

35. The multi-purpose fitness apparatus of claim 34, wherein the bench assembly comprises:

a. an elongate bench frame having a body portion defined by a front end portion and a rear end portion, the body portion having a top surface and a bottom surface;

b. a frame-connecting member mounted to the rear end portion of the elongate bench frame and adapted for moveably and detachably connecting the elongate bench frame to the lower holding bar of the vertical frame; and c. a seat pad moveably and detachably coupled to the top surface of the elongate bench frame.

36. The multi-purpose fitness apparatus of claim 35, further comprising a male connector extending substantially vertical to and mounted on the frame-connecting member.

37. The multi-purpose fitness apparatus of claim 35, further comprising a leg exercising mechanism having a leg lever and a leg support, the leg support being substantially perpendicular to the leg lever and flexibly coupled to the bottom surface of the front end portion of the elongate bench frame.

38. The multi-purpose fitness apparatus of claim 37, wherein the front end portion of the elongate bench frame is adapted for receiving and engaging the leg support of the leg exercising mechanism.

39. The multi-purpose fitness apparatus of claim 35, wherein the lower holding bar comprises at least one frame-connecting-member receiver formed on the body portion thereof, the frame-connecting-member receiver being adapted for enabling the frame-connecting member of the bench assembly to be affixed thereto.

40. The multi-purpose fitness apparatus of claim 39, wherein the frame-connecting-member receiver is one of an aperture, a groove, a notch and a slot.

41. The multi-purpose fitness apparatus of claim 34, wherein the vertical frame further comprises at least one foot-holder mounted on the lower holding bar thereof, the at least one foot-holder extending horizontally and adapted for anchoring a user's feet as the user doing a sit-up exercise.

42. The multi-purpose fitness apparatus of claim 35, wherein the bench assembly further comprises a wheel operably coupled to the bottom surface adjacent to the rear end portion of the elongate bench frame.

43. The multi-purpose fitness apparatus of claim 35, wherein the bench assembly further comprises a clip adapted for detachably affixing the seat pad to the elongate bench frame.

44. The multi-purpose fitness apparatus of claim 35, wherein the seat pad comprises a front seat pad and a rear seat pad, the rear seat pad moveably coupled to the front seat pad such that an angle $\alpha$ is formed between the front seat pad and the rear seat pad, and wherein the angle $\alpha$ is $0 \leqq \alpha \leqq 180$.

45. The multi-purpose fitness apparatus of claim 20, wherein the base comprises:

a. a pair of support bars, each support bar extending parallel to and spaced apart from the other support bar, each support bar having a body portion defined by a front end and a rear end;

b. a connecting bar connecting the pair of support bars and forming a vertical angle with each support bar;

c. a pair of pull-out bars slidably attached to the respective support bars, each pull-out bar extending parallel to and spaced apart from the other pull-out bar, and having a body portion defined by a front end portion and a rear end portion;

d. a pull-out-bar connector connecting the front end portions of the pair of pull-out bars and forming a vertical angle with each pull-out bar; and e. a platform having a body portion defined by a front end portion and rear end portion, the front end portion attached to the pull-out bar connector such that a movement of the pair of pull-out bars simultaneously moves the platform.

46. The multi-purpose fitness apparatus of claim 45, wherein the body portion of the support bars is adapted for enabling the pair of pull-out bars to slide in and out.

47. The multi-purpose fitness apparatus of claim 45, wherein the platform is situated below the connecting bar.

48. The multi-purpose fitness apparatus of claim 36, wherein the base comprises a female connector adapted for enabling the male connector to be affixed thereto.

49. A multi-purpose fitness apparatus, comprising:

a. a base;

b. a weight-supporting frame vertically mounted on the base;

c. at least one exercise mechanism coupled to the weight-supporting frame;

d. a resistance assembly for providing adjustable resistance, the resistance assembly vertically mounted on the base and located posterior to the weight-supporting frame;

e. a bench assembly moveably and detachably coupled to the weight-supporting frame, the bench assembly having a leg exercise mechanism operably attached thereto; and f. a connecting mechanism coupling the exercise mechanism to the resistance assembly such that a movement of the exercise mechanism is resisted by a resistance provided by the resistance assembly;

wherein the resistance assembly comprises:

(i) a supporting frame vertically mounted on the base, the supporting frame including a lower resistance support and an upper resistance support that is slidably coupled to the lower resistance support, wherein the upper resistance support has a body portion defined by a top end portion and a bottom end portion, and the lower resistance support has a body portion defined by a top end portion and a bottom end portion;

(ii) a vertical track member mounted on the lower resistance support of the supporting frame, the vertical track member extending vertically from about the top end portion to about the bottom end portion of the lower resistance support;

(iii) a top spring-attachment member having a body portion defined by a first end portion and an opposite, second end portion, the body portion extending horizontally and mounted on about the top end portion of the upper resistance support;

(iv) a bottom spring-attachment member having a body portion defined by a first end portion and an opposite, second end portion, the bottom spring-attachment member extending substantially parallel to and spaced apart from the top spring-attachment member and moveably coupled to the vertical track member such that a movement of the bottom spring-attachment member occurs within the vertical track member; and (v) a resilient resistance member having a body portion with a body length of l defined by a top end portion and a bottom end portion, the resilient resistance member extending substantially vertical to and detachably affixed to the top and bottom spring-attachment members, respectively.

50. The multi-purpose fitness apparatus of claim 49, wherein the base is extendable.

* * * * *